US010279954B2

(12) United States Patent
Bradford et al.

(10) Patent No.: US 10,279,954 B2
(45) Date of Patent: May 7, 2019

(54) CONTAINER HAVING TRACKS WITH ROUNDED EDGES TO FACILITATE MOVEMENT OF DUNNAGE SUPPORTS

(71) Applicant: Bradford Company, Holland, MI (US)

(72) Inventors: Judson A. Bradford, Holland, MI (US); Eric S. Bruinsma, Holland, MI (US)

(73) Assignee: Bradford Company, Holland, MI (US)

( * ) Notice: Subject to any disclaimer, the term of this patent is extended or adjusted under 35 U.S.C. 154(b) by 1227 days.

(21) Appl. No.: 14/281,246

(22) Filed: May 19, 2014

(65) Prior Publication Data

US 2015/0136643 A1 May 21, 2015

Related U.S. Application Data

(60) Provisional application No. 61/907,132, filed on Nov. 21, 2013.

(51) Int. Cl.

| | |
|---|---|
| ***B65D 19/06*** | (2006.01) |
| ***B65D 25/00*** | (2006.01) |
| ***B65D 57/00*** | (2006.01) |

(52) U.S. Cl.

CPC ..... *B65D 19/06* (2013.01); *B65D 25/005* (2013.01); *B65D 57/00* (2013.01); *B65D 2519/009* (2013.01); *B65D 2519/0082* (2013.01); *B65D 2519/0097* (2013.01); *B65D 2519/00333* (2013.01); *B65D 2519/00338* (2013.01); *B65D 2519/00497* (2013.01); *B65D 2519/00502* (2013.01); *B65D 2519/00582* (2013.01); *B65D 2519/00621* (2013.01); *B65D 2519/00646* (2013.01); *B65D 2519/00666* (2013.01);

(Continued)

(58) Field of Classification Search

CPC ..... B65D 19/44; B65D 25/00; B65D 25/04; B65D 25/06; B65D 25/005; B65D 25/10; B65D 81/07; B65D 81/075; B65D 81/05; B65D 85/68; B65D 88/546; B65D 90/12; B42F 15/02; B42F 15/0035; B42F 15/0094

USPC ..... 220/1.5, 1.6, 6, 9.4, 23.88, 495.01, 507, 220/528–530, 532–535, 543–544; 206/485, 583; 211/10, 40, 46, 71.01; 224/281, 554

See application file for complete search history.

(56) References Cited

U.S. PATENT DOCUMENTS

| | | | |
|---|---|---|---|
| 634,589 | A | 10/1899 | Russell |
| 1,712,168 | A | 5/1929 | Rand, Jr. |

(Continued)

FOREIGN PATENT DOCUMENTS

| | | |
|---|---|---|
| DE | 19549166 | 3/1997 |
| DE | 20101374 | 4/2001 |

(Continued)

*Primary Examiner* — Chun Hoi Cheung
*Assistant Examiner* — Brijesh V. Patel
(74) *Attorney, Agent, or Firm* — Wood, Herron & Evans, LLP

(57) ABSTRACT

A container for holding product therein during shipment and being returned for reuse has a body, tracks attached to opposite sides of the body, and a plurality of dunnage supports extending between the tracks. Outer portions of the dunnage supports may have one or more narrowed or flattened portions which enable the dunnage supports to slide along the tracks. Dunnage holding parts is suspended by the dunnage supports.

13 Claims, 21 Drawing Sheets

(52) U.S. Cl.
CPC ..... *B65D 2519/00701* (2013.01); *B65D 2519/00805* (2013.01); *B65D 2585/6882* (2013.01)

(56) References Cited

U.S. PATENT DOCUMENTS

| | | | | | |
|---|---|---|---|---|---|
| 3,093,140 | A | | 6/1963 | Guichard | |
| 4,527,694 | A | | 7/1985 | Bolt et al. | |
| 4,606,588 | A | * | 8/1986 | Koch | A47B 88/487 248/430 |
| 4,685,571 | A | | 8/1987 | Hoss | |
| 4,721,317 | A | | 1/1988 | Avot | |
| 4,752,142 | A | * | 6/1988 | Jackson | A47B 88/487 384/18 |
| 4,752,143 | A | * | 6/1988 | Lautenschlager, Jr. | A47B 88/487 312/334.31 |
| 4,770,314 | A | | 9/1988 | Giesler | |
| 4,778,230 | A | * | 10/1988 | Lautenschlager | A47B 88/427 312/334.5 |
| 4,821,879 | A | | 4/1989 | Kupersmit | |
| 4,864,686 | A | | 9/1989 | Lasier et al. | |
| 4,988,006 | A | | 1/1991 | Lundin | |
| 5,238,139 | A | | 8/1993 | Bisceglia | |
| 5,324,105 | A | | 6/1994 | Christensen | |
| 5,333,950 | A | * | 8/1994 | Zachrai | H02B 1/303 108/180 |
| 5,407,262 | A | | 4/1995 | Christian et al. | |
| 5,560,507 | A | | 10/1996 | Arpin et al. | |
| 5,725,119 | A | | 3/1998 | Bradford et al. | |
| 5,806,945 | A | * | 9/1998 | Anderson | A47B 96/145 312/265.3 |
| 5,813,566 | A | | 9/1998 | Bradford et al. | |
| 5,815,903 | A | | 10/1998 | Foster et al. | |
| 6,062,410 | A | | 5/2000 | Bradford et al. | |
| 6,132,020 | A | * | 10/2000 | Schael | A47B 88/493 312/334.1 |
| 6,164,440 | A | | 12/2000 | Van Bree | |
| 6,202,884 | B1 | | 3/2001 | Verkerke | |
| 6,230,916 | B1 | | 5/2001 | Bradford et al. | |
| 6,352,157 | B1 | | 3/2002 | Srinivasan | |
| 6,464,092 | B1 | | 10/2002 | Kortman et al. | |
| 6,540,096 | B1 | | 4/2003 | Bazany et al. | |
| 6,601,928 | B1 | | 8/2003 | Kortman et al. | |
| 6,830,156 | B2 | | 12/2004 | MacKelvie | |
| 7,125,062 | B2 | | 10/2006 | Kiester et al. | |
| 7,748,559 | B2 | | 7/2010 | Bradford | |
| 7,762,422 | B2 | | 7/2010 | Dobrinski | |
| 8,100,282 | B2 | | 1/2012 | Nyeboer et al. | |
| 2011/0284551 | A1 | | 11/2011 | Nyeboer et al. | |
| 2013/0057135 | A1 | | 3/2013 | Bradford et al. | |

FOREIGN PATENT DOCUMENTS

| | | |
|---|---|---|
| DE | 20318172 | 5/2004 |
| FR | 1455414 | 4/1966 |
| FR | 2860504 | 4/2005 |
| JP | 6-59230 | 8/1994 |
| WO | 9310024 | 5/1993 |

* cited by examiner

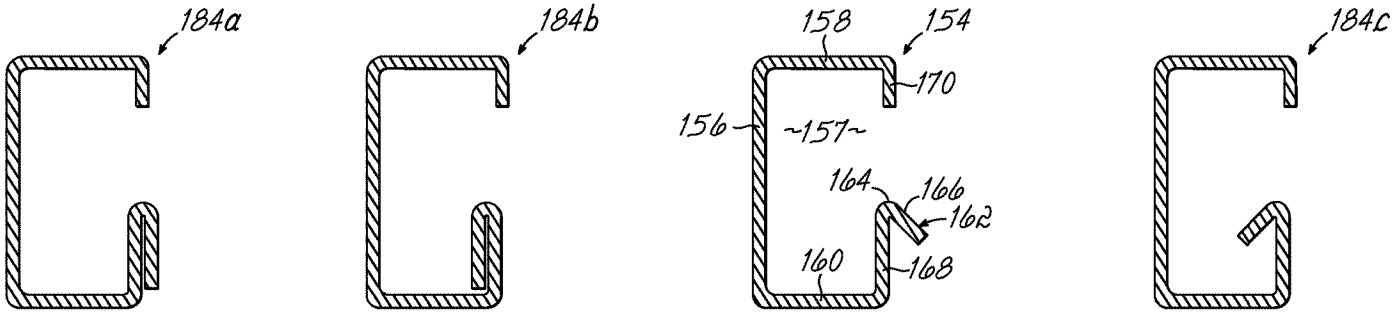
FIG. 9A
FIG. 9B
FIG. 9C
FIG. 9D
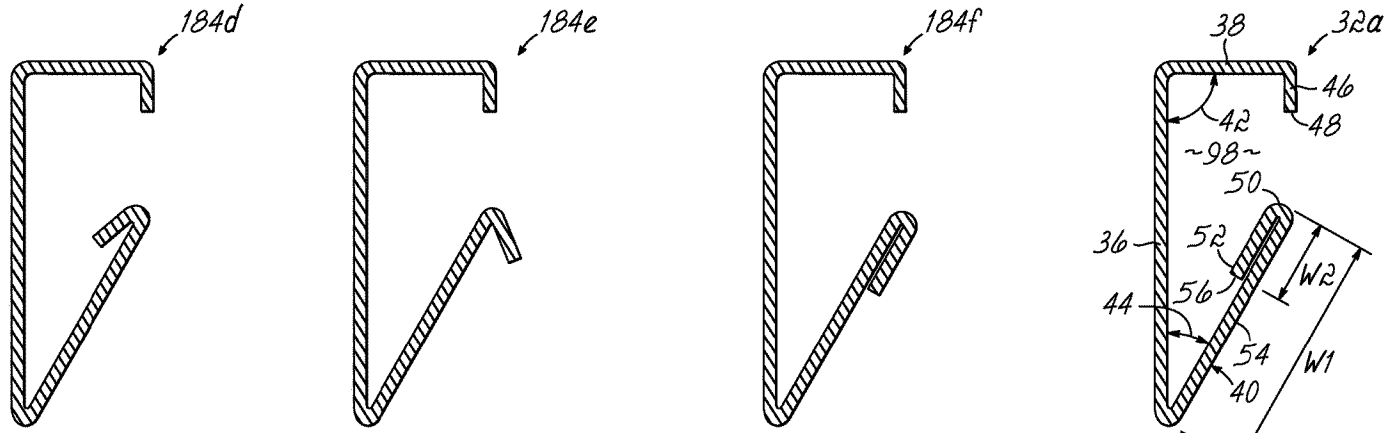
FIG. 9E
FIG. 9F
FIG. 9G
FIG. 9H

CONTAINER HAVING TRACKS WITH ROUNDED EDGES TO FACILITATE MOVEMENT OF DUNNAGE SUPPORTS

CROSS REFERENCE TO RELATED APPLICATIONS

The present application claims the benefit of U.S. Provisional Patent Application Ser. No. 61/907,132 filed Nov. 21, 2013, which is fully incorporated herein.

FIELD OF THE INVENTION

The present invention relates to containers for use in shipping and, more particularly, to containers with movable members for supporting product.

BACKGROUND OF THE INVENTION

A large number of different container structures are utilized by manufacturers to ship a variety of different products to end users, which may be, for example, assembly plants. In the automobile industry, for example, an assembly plant assembling a particular automobile might utilize a number of different parts from different manufacturers. These manufacturers ship their respective parts to the assembly plant in containers in which the parts are then removed from dunnage hanging from movable dunnage supports inside the container and assembled into a finished automobile.

Access to the product in the containers is of particular concern. Specifically, in the automotive industry, the containers full of product are positioned on an assembly line adjacent to a work area which is associated with a particular product to be installed on a manufactured vehicle. For example, a container full of parts is usually positioned next to a particular station on an assembly line where the parts are installed so that a line worker may easily access the parts inside the container. The product or part is taken directly from the container and used on the line. Some existing containers are difficult to access, which makes removal of the parts therein difficult and time consuming. For example, some containers are configured so that a line worker must walk around the container to remove parts or products from opposite ends of the container. As may be appreciated, a line worker only has a certain amount of time to install a part. Any delay in access and removal of the part from the container is undesirable.

In many containers, a line worker or employee must insert or remove parts from a distal or rear part of the container. The size and/or weight of the parts or work pieces may cause stress or strain on the line worker and, more particularly, on the back of the worker when inserting or removing parts from such a container. Such ergonomically unfriendly movements may cause physical trauma, pain and other injuries that may lead to lost production time.

In some situations, in order to alleviate such stress and/or strain on his or her body, the line worker may move to the rear or opposite end of the container to remove parts from inside the container. This requires space around the container which may not be available, depending on the physical layout of the plant or facility. The length (front to back) of certain containers may be limited because the container manufacturer needs to eliminate the need for a line worker to walk around the container to remove product from inside the container. Such containers having a reduced length reduce the number of parts or products which may be shipped and/or stored in the container. The more containers needed to ship a predetermined number of parts, the greater the cost to the shipper.

In some containers having multiple layers or level of parts, a line worker or employee must lean forward and bend down into the container to insert or remove a part or work piece from the bottom of the container. This movement by the line worker is ergonomically unfriendly because the line worker must lean forward and bend down into the container to insert or remove a part or work piece from the bottom of the container.

Depending upon the number of times the line worker repeats this unnatural motion, strain in the back, legs and arms may result. The size and/or weight of the parts or work pieces may increase the strain on the line worker. Thus, simply removing multiple parts during a work day may cause physical trauma, pain and other injuries that may lead to lost production time. Consequently, returnable and reusable containers having multiple levels of movable dunnage, such as the container disclosed in U.S. Pat. No. 8,308,015 have been used.

In known containers having multiple levels or layers of dunnage, such as pouches, a pocket may be sewn at the upper edges of each side of each pouch and sized to receive a dunnage support, such as a rod or a tube for example. The dunnage support may have rollers or end members secured to opposed ends of a middle member. The end members move in tracks secured to the sides of the container. The end members may add cost to the assembled container and present an opportunity for failure due to fatigue/wear. Therefore, a unitary metal tube or dunnage support may be desirable in some applications.

One difficulty with using unitary metal dunnage supports and metal rails is that friction between the metal rails and the metal dunnage supports may damage one or more of the metal rails and/or one or more of the metal dunnage supports after repeated movements of the dunnage supports. In addition, the amount of force necessary to move the dunnage supports along the rails may be greater than desired. Spall may be created and make the dunnage supports difficult to move.

Accordingly, there is a need for a returnable and reusable shipping container which has one or more layers of movable metal dunnage supports supporting dunnage and requires less effort to move the dunnage supports extending between metal rails than heretofore.

There is further a need for a returnable and reusable shipping container having multiple levels of movable dunnage therein which may be assembled without the need for dunnage supports having end members and may have an increased life compared to heretofore known containers.

SUMMARY OF THE INVENTION

The present invention provides a container for holding product therein during shipment that has a body having a bottom and at least two sides. The container further comprises at least one set of tracks supported by the container sides. Each of the tracks comprises a back and walls extending outwardly from the back. At least one of the walls has a rounded edge.

The container further comprises multiple movable dunnage supports extending between tracks on opposed sides of the container. Each of the dunnage supports has a narrowed portion at each end and an end portion. The narrowed portions of each dunnage support are engaged with and slidable along the rounded edges of the tracks to facilitate movement of the dunnage supports. The end portions are sized to remain inside the tracks during movement of the dunnage supports. The dunnage supports may be tubular in part or entirely. They may be made of any known material, including metal, such as aluminum, or plastic, such as polyvinylchloride, known as PVC. The dunnage supports may be unitary members or made of multiple pieces.

The container further comprises dunnage supported by the dunnage supports. The dunnage may comprise pouches or any other known form of dunnage for holding parts or products during shipment and storage so the parts do not become damaged. The dunnage may be suspended from the dunnage supports in any known manner and is not intended to limited to the dunnage shown in the drawings. For example, an upper portion of each side of a dunnage pouch may have a receptacle sewn therein in which resides one of the dunnage supports. Alternatively, the dunnage and, more particularly, the sides of the pouches, may be slotted so as to allow dunnage supports to be woven through the slots in the dunnage without the need for sewing, although sewing may be utilized in specific areas of the pouch.

According to another aspect of the invention, the container for holding product therein during shipment has a bottom and at least two side structures. The container comprises multiple levels of tracks supported by opposed side structures. Each of the tracks comprises a back and walls extending outwardly from the back. At least one of the walls has a rounded edge.

The container further comprises a plurality of dunnage supports extending between and supported by the tracks. At least some of the dunnage supports have flattened portions at opposed ends thereof. The flattened portions contact and slide along the rounded edges of the tracks.

The container further comprises dunnage supported by the dunnage supports. The dunnage may comprise pouches or any other known form of dunnage. The dunnage may be suspended from the dunnage supports in any desired known manner.

According to another aspect of the invention, the container for holding product therein during shipment has a bottom and at least two sides. The container further comprises tracks supported by the sides at different vertically spaced levels. Each of the tracks has at least one rounded edge. A plurality of dunnage supports extend between opposed tracks at the same vertical level. Each of the dunnage supports has flattened portions and end portions. Each of the end portions resides inside an interior of one of the tracks. Two of the flattened portions of one of the dunnage supports extend through gaps in opposed tracks. The flattened portions are engaged with and slidable along the rounded edges of the tracks. The container may further comprise dunnage suspended from the dunnage supports in any known manner. The dunnage may comprise pouches or any other known form of dunnage.

According to another aspect of the invention, the container for holding product therein during shipment has a bottom and at least two sides. The container further comprises braces secured to each of the sides. Vertically spaced sets of tracks are secured to each of the braces. Each of the tracks has a back, walls extending outwardly from the back, at least one of the walls having a rounded edge to facilitate movement of a plurality of movable dunnage supports. Each of the dunnage supports has a flattened portion at each end. Each of the flattened is engaged with and slidable along the rounded edges of the tracks to facilitate movement of the dunnage supports inside the container. The container may further comprise dunnage supported by the dunnage supports in any known manner. The dunnage may comprise pouches or any other known form of dunnage.

The above and other objects and advantages of the present invention shall be made apparent from the accompanying drawings and the brief description thereof.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

FIGS. 9A-9H are cross-sectional views showing different tracks;

DETAILED DESCRIPTION OF THE INVENTION

Figure 1:
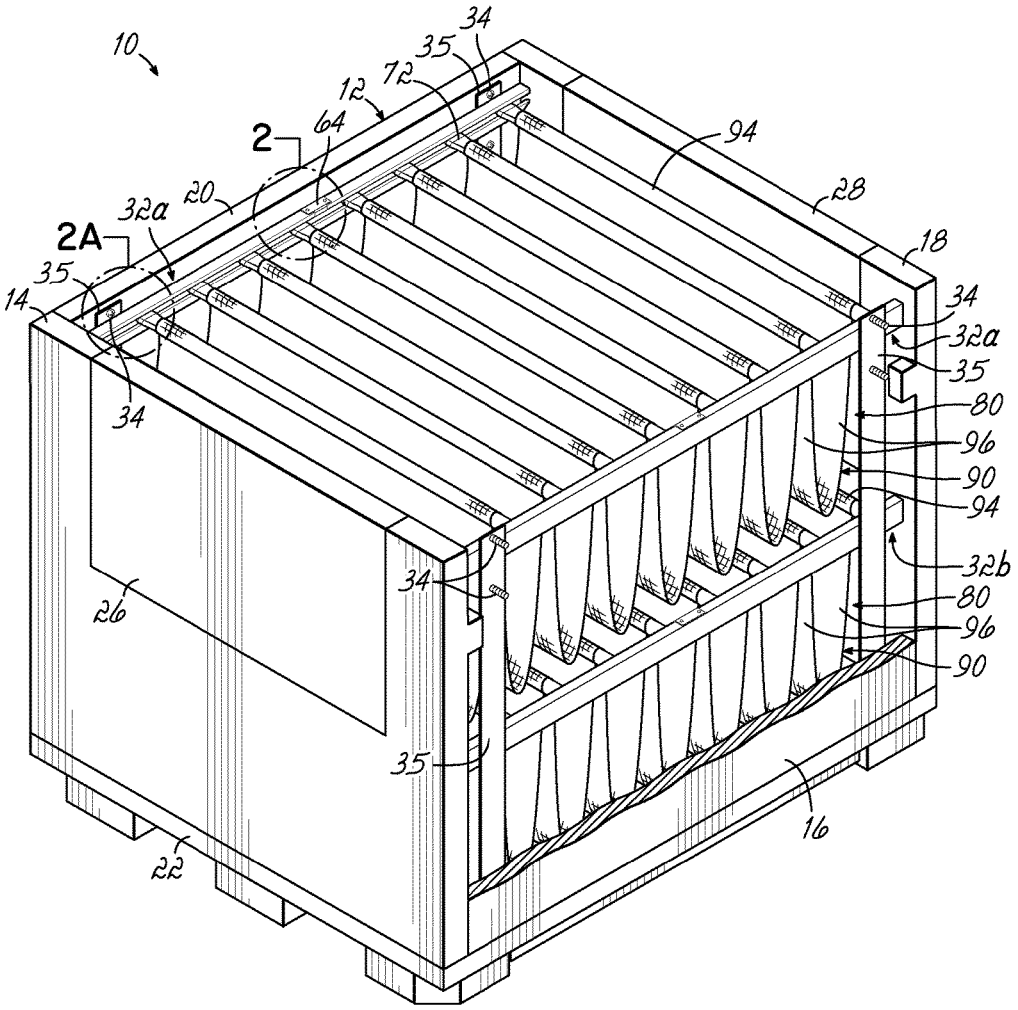
FIG. 1 is a perspective view of a portion of one embodiment of a reusable and returnable container showing two layers of tracks, dunnage supports and associated dunnage in the form of pouches.
Figure 18:
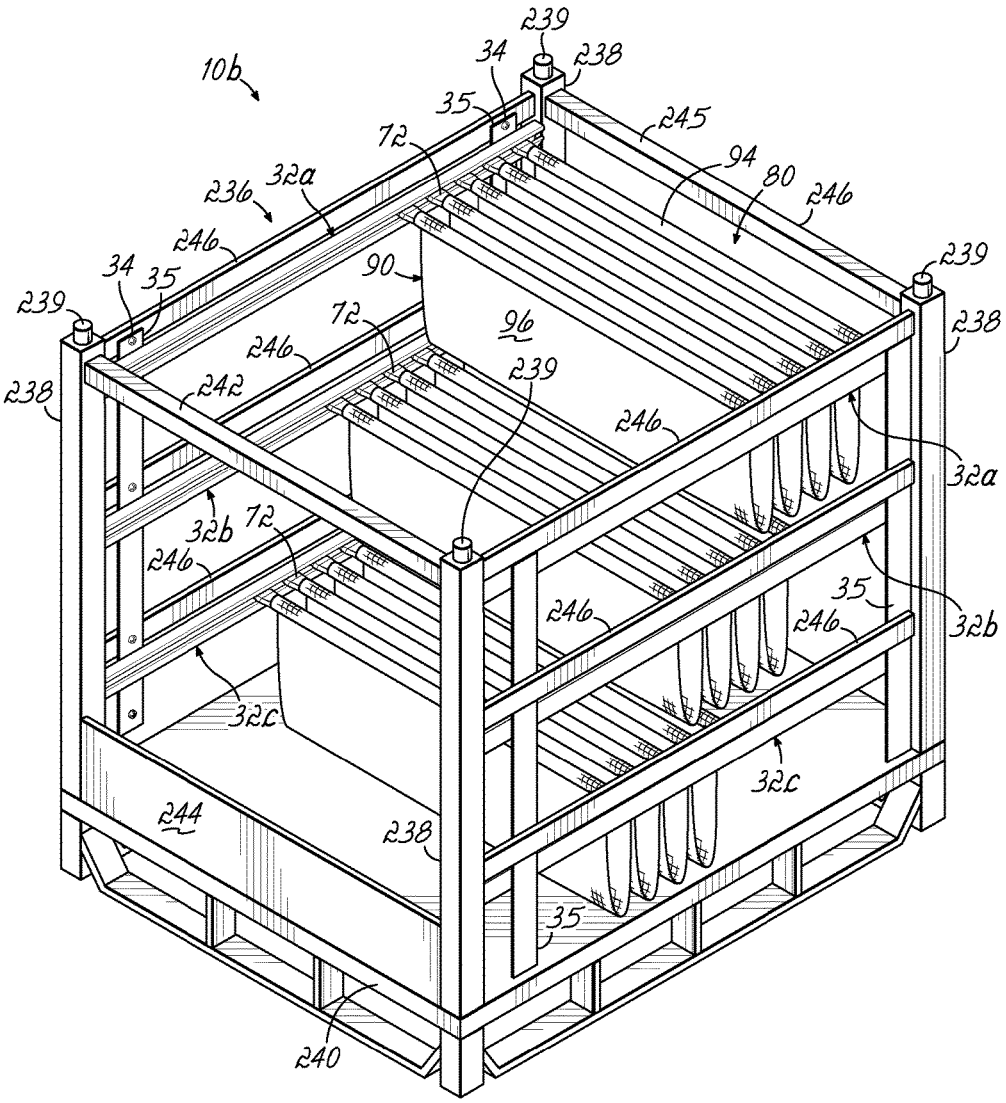
FIG. 18 is a perspective view of a portion of an alternative embodiment of a reusable and returnable container having three levels or layers of track assemblies, dunnage supports and associated dunnage in the form of pouches.

Referring to FIG. 1, there is illustrated a reusable and returnable container 10. The container 10 comprises a body 12 having a front 14, a side 16 (partially broken away), a rear 18 and another side 20, all extending upwardly from a base or bottom 22. Although one type of container is illustrated, the present invention may be used with any type or configuration of container. For example, the present invention may be used in a container in which one or more of the sides of the container are hinged for the container to be more easily erected and/or compacted for storage. As shown in FIG. 18, the container may also be a rack type of container which has four corner posts extending upwardly from a base. For purposes of this document, any of the structures 14, 16, 18 or 20 may be considered side structures or sides or walls or wall structures.

A cover (not shown) may also be included to enclose the container 10 and further protect and secure products 24 (shown in phantom in FIGS. 16A, 16B and 16C) during shipment. Although one configuration of product 24 is illustrated and described herein, the present invention may be used to store and ship other configurations of product not shown or described. This document is not intended to limit the type of product being shipped or stored.

As shown in FIGS. 1, 16A, 16B and 16C, front wall or side structure 14 and the rear wall or side structure 18 of container 10 each may have a drop down door 26, 28, respectively. Each door 26, 28 may be hinged to the remainder of the wall or side structure 14, 18, respectively using hinges 30 (see FIGS. 16A, 16B and 16C). Each door 26, 28 may be locked in a closed or upright position shown in FIG. 1 or dropped into an open position shown in FIGS. 16A and 16B to facilitate loading or unloading product 24 from the container 10. One type of container (without dunnage or tracks or track assemblies) which has such lockable doors is available from the Orbis Corporation of Oconomowoc, Wis.

The container 10 further comprises a plurality of tracks 32*a*, 32*b* arranged in pairs. The tracks 32*a*, 32*b* are welded or otherwise secured to braces 35 which are secured to the body 12 and, more particularly, to opposed sides or side structures 16, 20 of the body 12 via fasteners 34, as best shown in FIG. 1. However, the tracks 32*a*, 32*b* may be secured directly to the container body 12 in any known manner without the use of braces. In either case, the container body 12 supports the tracks 32*a*, 32*b*, either directly or indirectly. Although two braces 35 are shown per side, any number of braces may be used of any desired size.

FIG. 1 shows container 10 having two levels or vertically spaced layers of tracks 32*a*, 32*b*. However, this document is not intended to limit the number of levels or layers of tracks of any of the embodiments shown or described herein. An upper pair of tracks 32*a* may be welded or otherwise secured to braces 35 secured to opposed sides or side structures 16, 20 of the body 12 at the same vertical level or height inside the container 10. Similarly, a lower pair of tracks 32*b* may be welded or otherwise secured to braces 35 secured to opposed sides or side structures 16, 20 of the body 12 at the same vertical level or height inside the container 10 below upper tracks 32*a*.

Figure 2:
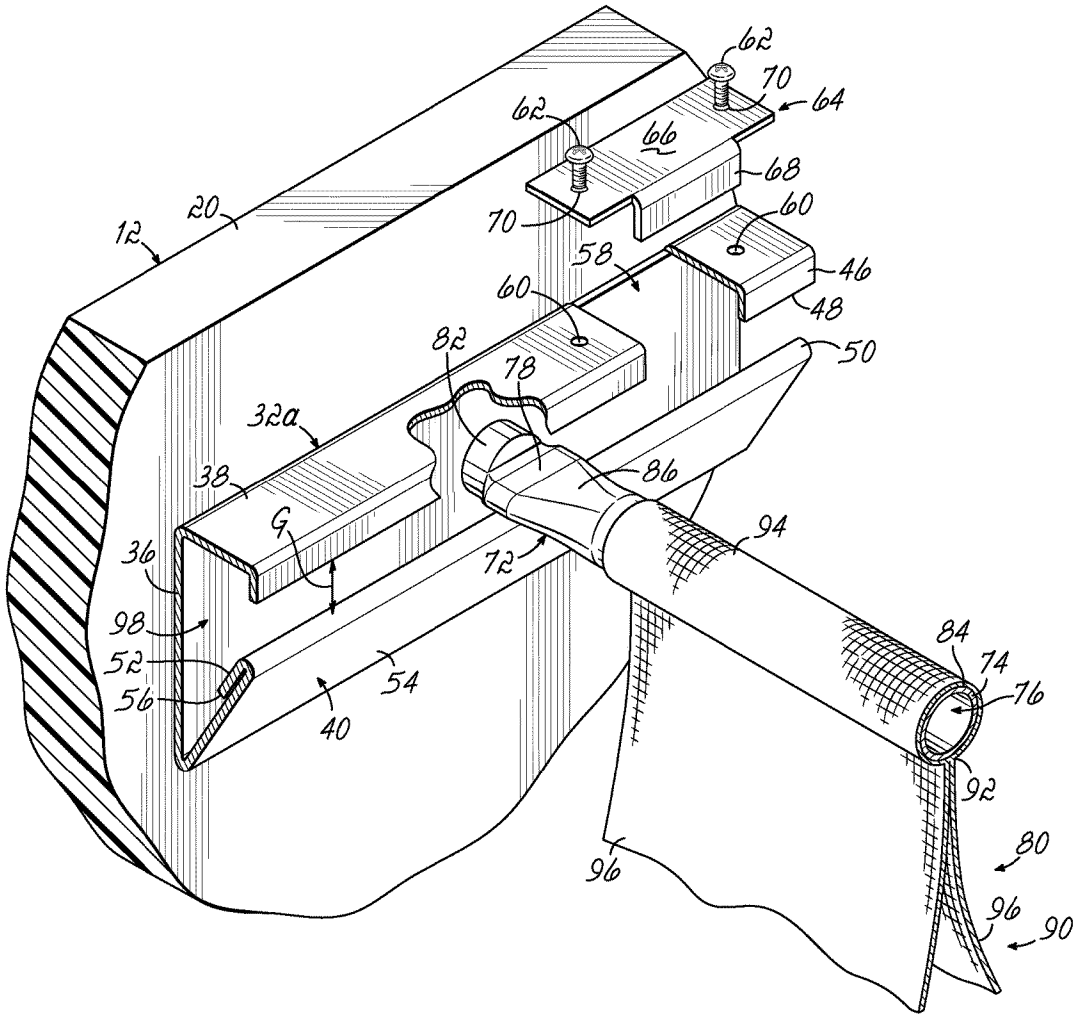
FIG. 2 is a perspective view of the encircled area 2 of FIG. 1.
Figure 2A:
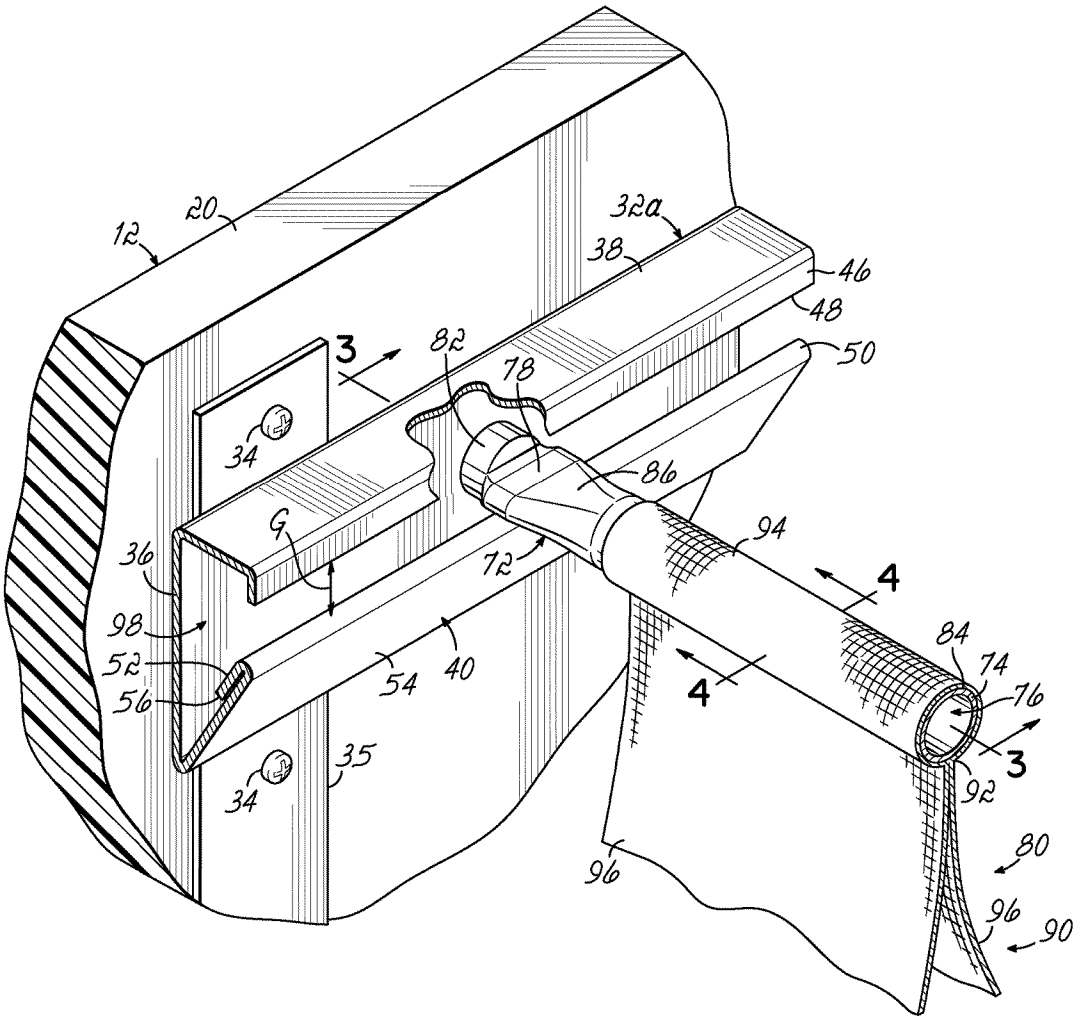
FIG. 2A is a perspective view of the encircled area 2A of FIG. 1.
Figure 3:
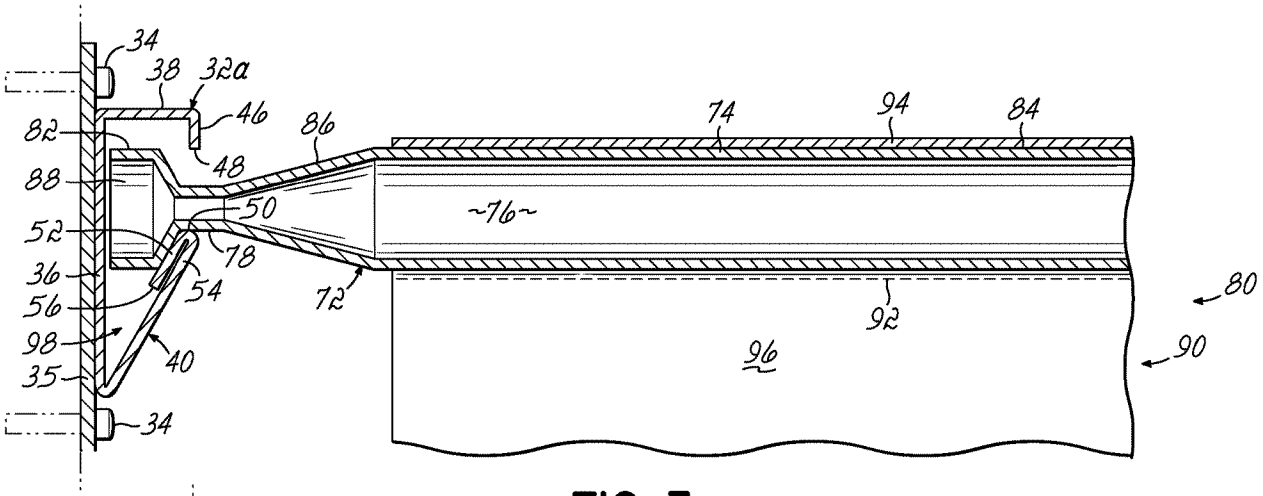
FIG. 3 is a schematic cross-sectional view taken along the line 3-3 of FIG. 2A.

As best shown in FIGS. 2, 2A and 3, each track 32*a* comprises a back 36, an upper wall 38 and a lower wall 40 each extending outwardly from the back 36. The upper wall 38 extends outwardly from the back 36 at a generally right angle 42 so the upper wall 38 is generally perpendicular to the back 36. See FIG. 9H. However, the lower wall 40 extends outwardly from the back 36 at an acute angle 44 so the lower wall 40 is not perpendicular to the back 36. The track 32*a* further comprises an upper lip 46 extending downwardly from the inner edge of the upper wall 38. The upper lip 46 has a terminal edge 48. As shown in FIGS. 2, 2A and 9H, track 32*a* has a hollow interior 98. Each track 32*b* (and additional tracks when necessary) is identical to track 32*a* in the illustrated container 10. However, it is within the contemplation of the present invention that the tracks may be different at different vertical levels in any of the containers shown or described herein. However, the tracks at the same level are preferably identical.

The lower wall 40 of track 32*a* is folded back upon itself to create a smooth continuous rounded edge 50 between an inner ply 52 and an outer play 54. Although the inner ply 52 is shown contacting the outer ply 54, the inner and outer plies 52, 54, respectively, need not contact each other. See FIG. 9E. Although the inner ply 52 is shown having a width W1 less than the width W2 of the outer ply 54, the inner and outer plies 52, 54, respectively, may be any desired width including the same width. See FIG. 9H. In other words, the terminal edge 56 of the lower wall 40 may at any desired location.

As best shown in FIGS. 2 and 3, the linear distance between the terminal edge 48 of upper lip 46 and the smooth continuous rounded edge 50 of track 32*a* defines a gap "G" which functions as a barrier preventing the dunnage supports 72 from separating from the tracks during their movement inside the container. The gap "G" further provides a slotted area inside which portions of the dunnage supports 72 may move quietly and efficiently. Although not shown in detail, all the other tracks of container 10, including tracks 32*b*, are identical.

FIG. 2 illustrates another feature or aspect of the invention. Each track 32*a* has an opening or cut-out 58 formed therein. Holes 60 are formed in the upper wall 38 of track 32*a*, which are sized and threaded to receive fasteners 62. Although fasteners 62 are illustrated to be screws, they may be any other desirable fastener. A cap 64 is removably secured to the track 32*a* to cover the opening or cut-out 58 formed in an upper portion of track 32*a*. As best seen in FIG. 2, cap 64 has a generally inverted L-shaped cross-sectional configuration, including a top portion 66 and a side portion 68 extending downwardly from the top portion 66. Holes 70 are formed through the top portion 66 of the cap 64 and sized to receive fasteners 62, as shown in FIG. 2. The fasteners 62 are adapted to pass through the holes 70 in the cap 64 and into the holes 60 in the upper wall 38 of the track 32*a*. Caps of alternative shapes or sizes may be used if desired. Although not shown in detail, all the other tracks of container 10, including tracks 32*b*, may have the same cut-out and cap.

When one or more of the dunnage supports 72 or any part thereof are damaged or need to be replaced for any reason, one may remove cap 64 after loosening fasteners 62, thereby exposing the opening or cut-out 58 of track 32*a*. One or more dunnage supports 72 may then be removed or inserted as necessary to repair or replace the damaged part or parts.

Figure 3A:
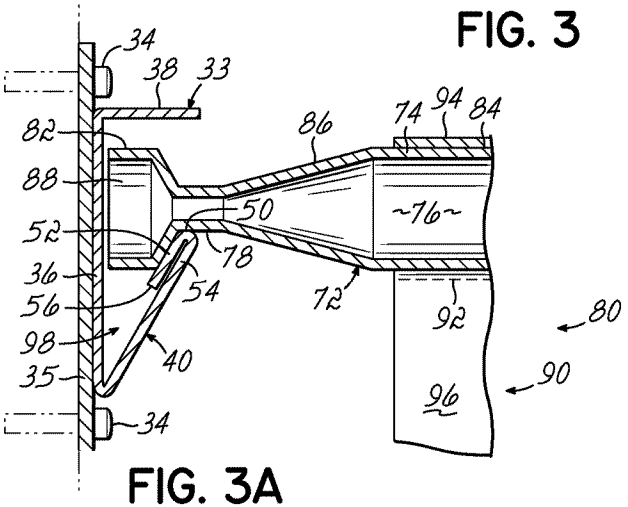
FIG. 3A is a view like FIG. 3 showing a track of a slightly different configuration.

FIG. 3A illustrates an alternative configuration of track 33 identical to track 32*a* but lacking an upper lip. Although FIGS. 1 and 2 illustrate tracks 32*a*, 32*b*, the container 10 may alternatively be equipped with tracks 33, as shown in FIG. 3A. In any of the containers shown or described herein, the tracks may be like tracks 32*a*, 32*b* shown in FIGS. 1-3, or like track 33 shown in FIG. 3A.

FIG. 1 illustrates two levels of dunnage supports 72, each dunnage support 72 being a unitary member and extending between a pair of tracks 32*a*, 32*b* at the same level or height. The tracks 32*a*, 32*b* or 33, in combination with the braces 35, support the weight of the dunnage supports 72 and associated dunnage 80, as described below. FIGS. 2, 2A and 3 illustrate a portion of one of the dunnage supports 72. As shown in FIG. 3, each dunnage support 72 has a tubular wall 74 and a hollow interior 76. Dunnage support 72 has two flattened or indented portions 78, one at each end (only one being shown) which contact and move along the rounded edge 50 of opposed tracks at the same vertical level or height. Outside of each flattened or crimped portion 78 is an end portion 82 which is approximately the same diameter as the middle portion 84 of the tubular dunnage support 72. Inside of each flattened or crimped portion 78 is a tapered portion 86.

As best shown in FIGS. 2 and 2A, each dunnage support 72 at each end has a flattened portion 78 located inwardly from an end portion 82 (only one being shown). The flattened portions 78 of each dunnage support 72 rest on top of the rounded lip edges 50 of the lower walls 40 of the tracks 32*a*, as shown in FIGS. 2 and 2A and slide thereon (only one being shown in FIGS. 2 and 2A). The flattened portion 78 is sized to reside on and engage one of the rounded lip edges 50 of one of the lower walls 40 of one of the tracks 32*a*. The end portion 82 of each dunnage support 72 resides inside the interior 98 of one of the tracks 32*a* and moves therein upon movement of the dunnage support 72. The end portion 82 of each dunnage support 72 has a hollow interior 88.

Each dunnage support 72 may be any desired configuration and is not intended to be limited by the drawings of this document. Similarly, the location and number of flattened portion 78 of each dunnage support 72 is not intended to be limited by the drawings of this document. Each dunnage support 72 may be a single unitary piece or multiple pieces joined together as shown generally in FIGS. 15 and 16.

The rounded edge 50 of the tracks facilitates movement of the dunnage supports 72 from front to back or back to front inside the container. The presence of the rounded edges 50 of the tracks 32*a*, 32*b* makes moving the dunnage supports 72 at any level easier for an operator from an ergonomic standpoint and thus, may reduce the time necessary to load or unload a container. A further benefit may be reduced injuries or time off work from operators using such containers to load or unload parts from the dunnage inside the containers.

The dunnage 80 of each level or layer may comprise one or more pieces of dunnage material. In one embodiment, one piece of dunnage material is used for one level or layer of dunnage 80. However, multiple pieces of material may be used in one or more levels or layers of dunnage. The material may be a textile material, such as polyester. However, this document is not intended to limit the material of the dunnage.

The drawings show the dunnage 80 supported by the dunnage supports 72 being in the form of pouches 90, each level having its own level of pouches. Two adjacent dunnage supports 72 support a pouch 90. Each level of pouches 90 may be made from one piece of material or multiple pieces of material. As best shown in FIGS. 2 and 2A, the dunnage 80 or pouches 90 at each level may be supported by the dunnage supports 72.

Figure 4:
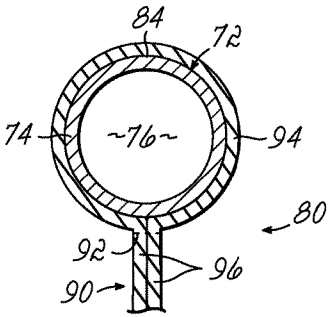
FIG. 4 is a cross-sectional view taken along the line 4-4 of FIG. 2A.

As shown in FIGS. 2, 2A and 3, the dunnage material may be secured to itself via sewing or welding along a seam 92, as is known, to create a receiver or pocket 94. One of the dunnage supports 72 passes through receiver 94. Two plies of fabric 96 which form sides of adjacent pouches 90 hang downwardly from the receiver or pocket 94, as best shown in FIG. 4.

Figure 5:
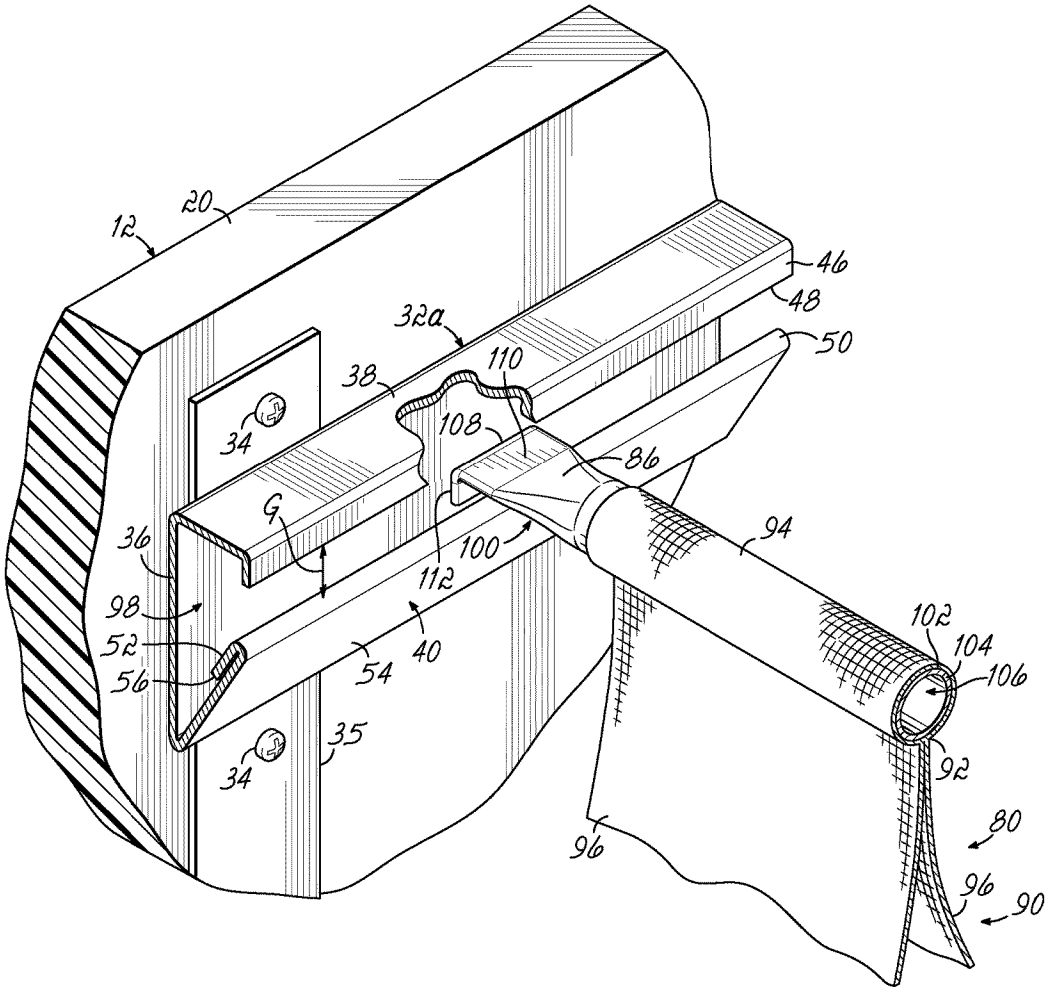
FIG. 5 is a perspective view like FIG. 2A showing a different dunnage support.

FIG. 5 illustrates another embodiment of dunnage support 100 which may be used in any of the containers shown or described herein and with any desired dunnage and in combination with any of the tracks shown or described herein. FIG. 5 illustrates the same track 32*a* shown in FIGS. 1-4 and described herein, welded or otherwise secured to braces 35. Braces 35 are secured to the body 12 and, more particularly, to opposed sides or side structures 16, 20 of the body 12 via fasteners 34. However, FIG. 5 illustrates a different dunnage support 100 having two end portions 108 (only one being shown).

As shown in FIG. 5, each dunnage support 100 has a central portion 102 comprising a tubular wall 104 and a hollow interior 106. As best shown in FIG. 5, each dunnage support 100 at each end has an end portion 108 (only one being shown) comprising a first flattened portion 110 and a second flattened portion 112. The flattened portion 110 rests on top of one of the rounded edges 50 of one of the tracks 32*a* (or tracks 32*b* or any other tracks shown or described herein), as shown in FIG. 5, and slides thereon. The flattened portion 112 is generally perpendicular to the flattened portion 110 and is sized to reside in the interior 98 of one of the tracks 32*a*. A portion of the end portion 108 of each dunnage support 100 resides inside the interior 98 of one of the tracks 32*a* and moves therein upon movement of the dunnage support 100. Each dunnage support 100 may be any desired configuration and is not intended to be limited by the drawings of this document. Similarly, the location and number of flattened portions of each dunnage support 100 is not intended to be limited by the drawings of this document. Each dunnage support 100 may be a single unitary piece or multiple pieces joined together as shown generally in FIGS. 15 and 16.

Figure 6:
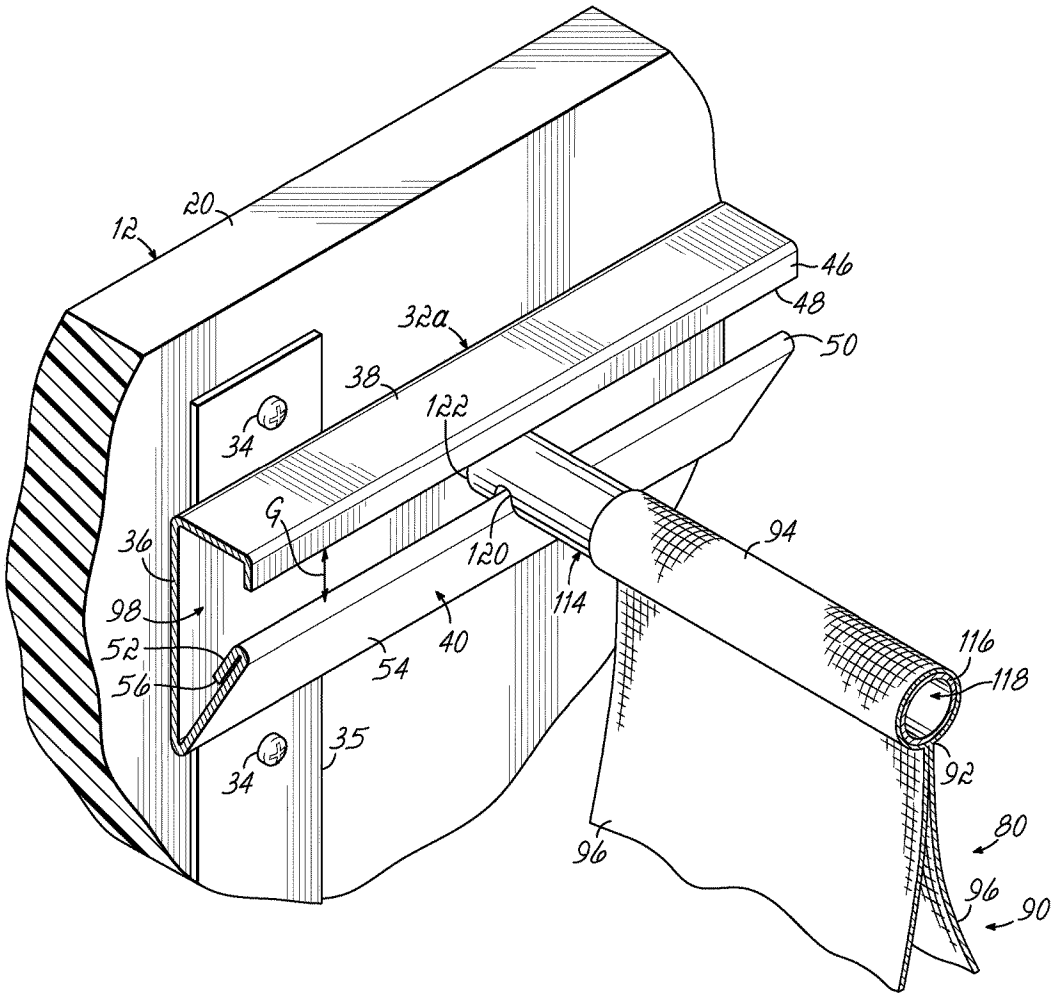
FIG. 6 is a perspective view like FIG. 2A showing a different dunnage support.

FIG. 6 illustrates another embodiment of dunnage support which may be used in any of the containers shown or described herein and with any desired dunnage and in combination with any of the tracks shown or described herein. FIG. 6 illustrates the same track 32*a* shown in FIGS. 1-5 and described herein welded or otherwise secured to braces 35 which are secured to the body 12 and, more particularly, to opposed sides or side structures 16, 20 of the body 12 via fasteners 34. However, FIG. 6 illustrates a different dunnage support 114 having two end portions 122 (only one being shown).

As shown in FIG. 6, each dunnage support 114 is a unitary member comprising a tubular wall 116 and a hollow interior 118. As best shown in FIG. 6, each dunnage support 114 at each end has a notch or cut-out 120 located inside an end portion 122 (only one being shown). The notch 120 rests on top of one of the rounded edges 50 of one of the tracks 32*a*, as shown in FIG. 6, and slides thereon. The end portion 122 is sized to reside in the interior 98 of one of the tracks 32*a*. A portion of the end portion 122 of each dunnage support 114 resides inside the interior 98 of one of the tracks 32*a* and moves therein upon movement of the dunnage support 114. Each dunnage support 114 may be any desired configuration and is not intended to be limited by the drawings of this document. Similarly, the location and size of notches 120 of each dunnage support 114 are not intended to be limited by the drawings. Each dunnage support 114 may be a single unitary piece or multiple pieces joined together as shown generally in FIGS. 14 and 15.

Figure 7:
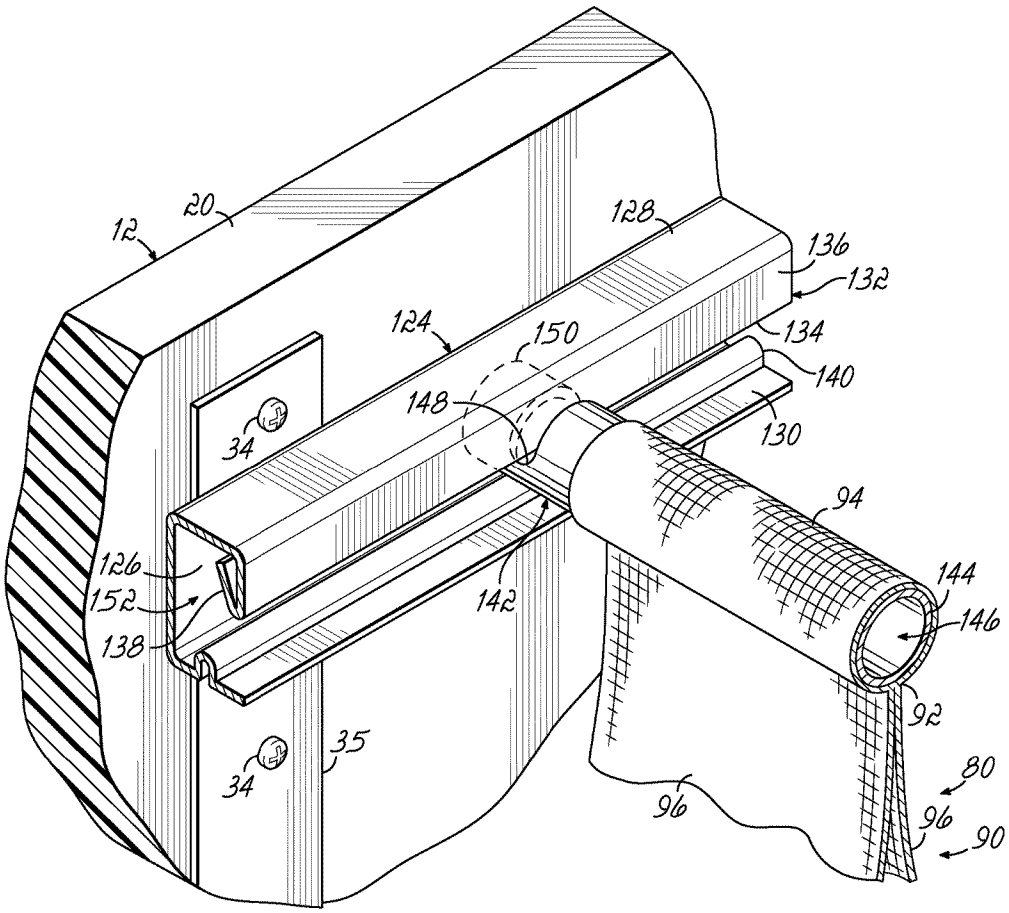
FIG. 7 is a perspective view like FIG. 2A showing a different track and a different dunnage support.

FIG. 7 illustrates a generally C-shaped track 124 which may be used in any of the containers and/or embodiments illustrated or described herein. The track 124 may be welded or otherwise secured to braces 35 which are secured to the body 12 and, more particularly, to opposed sides or side structures 16, 20 of the body 12 via fasteners 34, as best shown in FIG. 7. However, the tracks 124 may be secured directly to the container body 12 in any known manner without the use of braces. In either case, the container body 12 may support the tracks 124, either directly or indirectly in any of the embodiments shown or described herein. Tracks 124 may be used in connection with any of the dunnage supports or containers described or illustrated herein.

As shown in FIG. 7, each track 124 comprises a back 126, an upper wall 128 and a lower wall 130 each extending outwardly from the back 126. The track 124 further comprises an upper lip 132 extending downwardly from the upper wall 128. The upper lip 132 is folded or bent (turned upwardly in FIG. 7) to create a rounded longitudinally extending edge 134. The upper lip 132 thereby becomes two ply with an outer layer or ply 136 outside an inner ply 138. Although outer ply 136 is illustrated being separated from the inner ply 138 so they do not touch, they may contact each in certain applications. The inner ply 138 is merely an extension of the outer ply 136 of upper lip 132. An acute angle is formed between the outer and inner plies, 136, 138. The track 124 further comprises an inverted U-shaped bump or guide 140 extending longitudinally along the lower wall 130 of the track 124.

A dunnage support 142 is used with and extends between tracks 124. As shown in FIG. 7, each dunnage support 142 has a tubular or cylindrical wall 144 and a hollow interior 146. As best shown in FIG. 7, each dunnage support 142 at each end has an upper notch or cut-out 148 located inside an end portion 150 of the dunnage support 142 (only one being shown). The dunnage support 142 rests on top of the inverted U-shaped bump or guide 140 of the lower lip 130 of track 124 and slides thereon. The upper notch 148 is sized to receive and engage upper lip 132 of track 124. The end portion 150 of each dunnage support 142 resides inside the interior 152 of one of the tracks 124 and moves therein upon movement of the dunnage support 142. Each notch or cut-out may be any desired configuration and is not intended to be limited by the drawings of this document. Similarly, the location and number of notches or cut-outs of each dunnage support is not intended to be limited by the drawings of this document. In some instances, the upper lip 132 of track 124 and the upper notch 148 may be omitted. Each dunnage support 142 may be a single unitary piece or multiple pieces joined together as shown generally in FIGS. 14 and 15. In some instances, the lower lip 130 of track 124 may be doubled upon itself to create a rounded edge (not shown) like the rounded edges of the lower track lips shown in FIGS. 2 and 2A.

Figure 8:
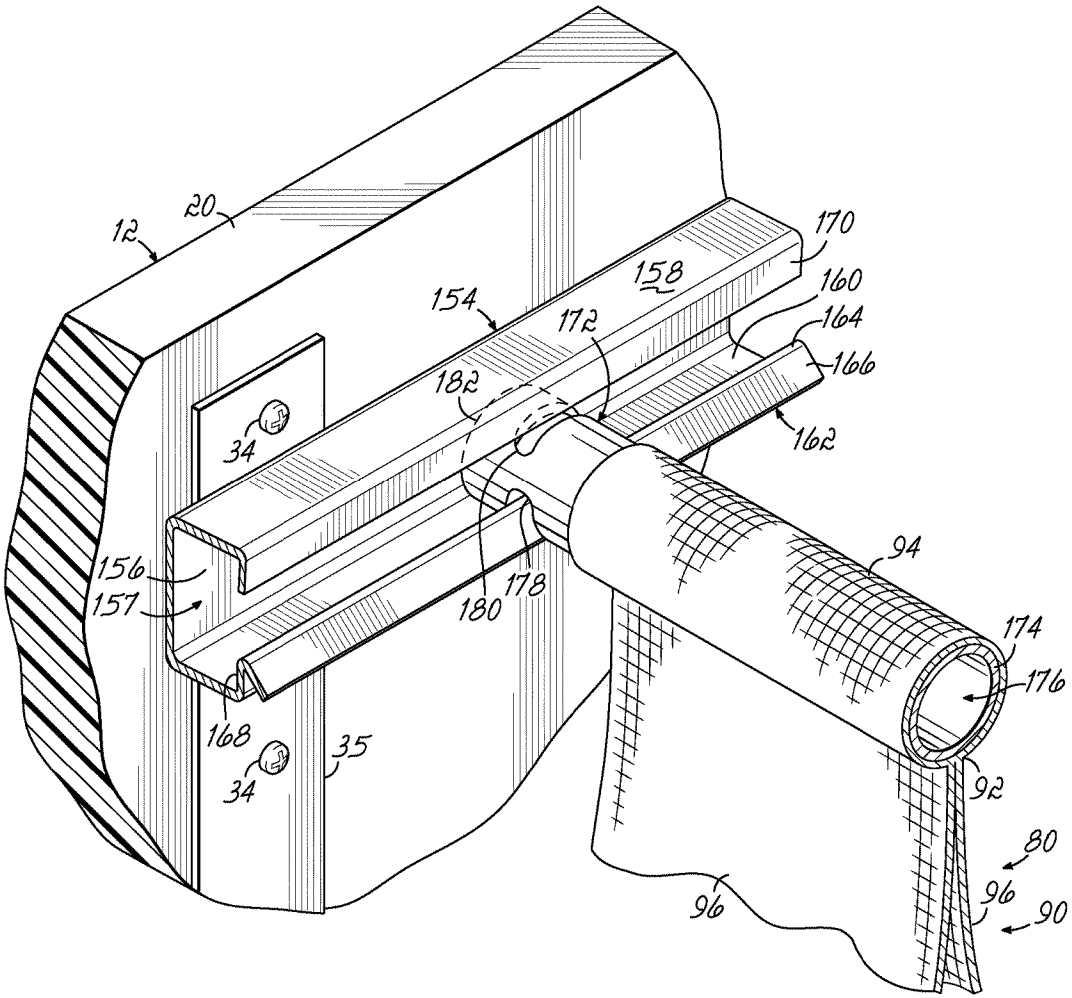
FIG. 8 is a perspective view like FIG. 2A showing a different track and a different dunnage support.
Figure 10A:
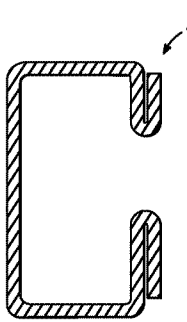
FIGS. 10A-10H are cross-sectional views showing different tracks.
Figure 10B:
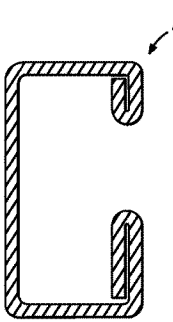
Figure 10C:
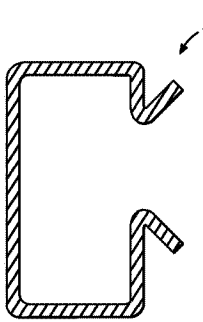
Figure 10D:
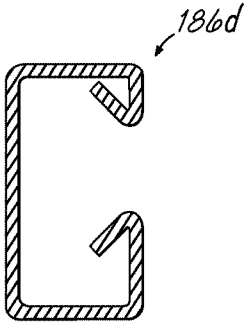
Figure 10E:
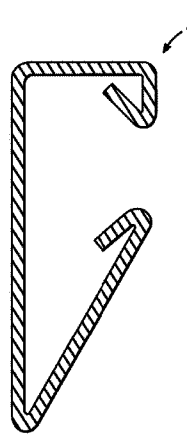
Figure 10F:
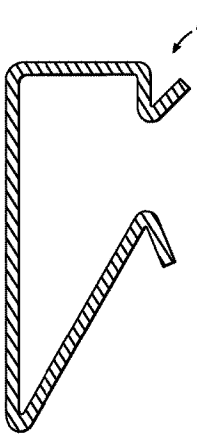
Figure 10G:
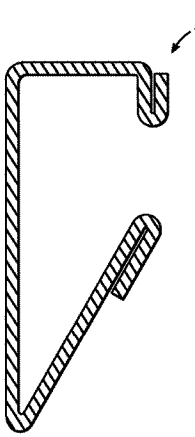
Figure 10H:
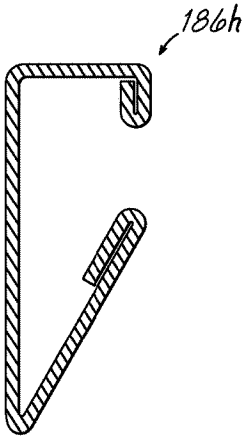

FIG. 8 illustrates a generally C-shaped track 154 which may be used in any of the containers and/or embodiments illustrated or described herein. The track 154 may be welded or otherwise secured to braces 35 which are secured to the body 12 and, more particularly, to opposed sides or side structures 16, 20 of the body 12 via fasteners 34, as best shown in FIG. 8. However, the tracks 154 may be secured directly to the container body 12 in any known manner without the use of braces. In either case, the container body 12 may support the tracks 154, either directly or indirectly in any of the embodiments shown or described herein. Tracks 154 may be used in connection with any of the dunnage supports or containers described or illustrated herein.

As shown in FIGS. 8 and 9C, each track 154 comprises a back 156, an upper wall 158 and a lower wall 160 each extending outwardly from the back 156. The track 154 further comprises a lower lip 162 extending upwardly from the inner edge of the lower wall 160. The lower lip 162 is folded or bent (turned downwardly in FIGS. 8 and 9C) to create a rounded, longitudinally extending edge 164. The lower lip 162 thereby becomes two ply with an outer layer or ply 166 outside an inner ply 168. The outer ply 166 is separated from the inner ply 168 so they do not touch. The outer ply 166 is merely an extension of the inner ply 168 of lower lip 162. An acute angle is formed between the outer and inner plies, 166, 168. The track 154 further comprises an upper lip 170 extending downwardly from the inner edge of the upper wall 158.

A dunnage support 172 is used with and extends between tracks 154. As shown in FIG. 8, each dunnage support 172 has a tubular or cylindrical wall 174 and a hollow interior 176. As best shown in FIG. 8, each dunnage support 172 at each end has a lower notch or cut-out 178 and an upper notch or cut-out 180, each notch 178, 180 being located inside an end portion 182 of the dunnage support 172 (only one being shown). The lower notch 178 rests on top of the lower lip 162 of track 154 and slides thereon. The upper notch 180 is sized to receive and engage upper lip 170 of track 154. The end portion 182 of each dunnage support 172 resides inside the interior 157 of one of the tracks 154 and moves therein upon movement of the dunnage support 172. Each notch or cut-out may be any desired configuration and is not intended to be limited by the drawings of this document. Similarly, the location and number of notches or cut-outs of each dunnage support is not intended to be limited by the drawings of this document. In some instances, the upper lip 170 of track 154 and/or the upper notch 180 of dunnage support 172 may be omitted. Each dunnage support 172 may be a single unitary piece or multiple pieces joined together as shown generally in FIGS. 14 and 15. In some instances, the upper lip 170 of track 154 may be doubled upon itself to create a rounded edge (not shown) like the rounded edges of the lower track lips shown in FIGS. 2 and 2A.

FIGS. 9A-9E and 9G illustrate alternative cross-sectional views of alternative tracks 184*a*-184*f* which may be used in any of the containers shown or described herein and may be used in conjunction with any of the dunnage supports shown or described herein. FIG. 9C illustrates a cross-sectional view of track 154 also shown in FIG. 8. FIG. 9H illustrates a cross-sectional view of track 132*a* also shown in FIGS. 1-6.

FIGS. 10A-10H illustrate alternative cross-sectional views of alternative tracks 186*a*-186*h* which may be used in any of the containers shown or described herein and may be used in conjunction with any of the dunnage supports shown or described herein.

Figure 11:
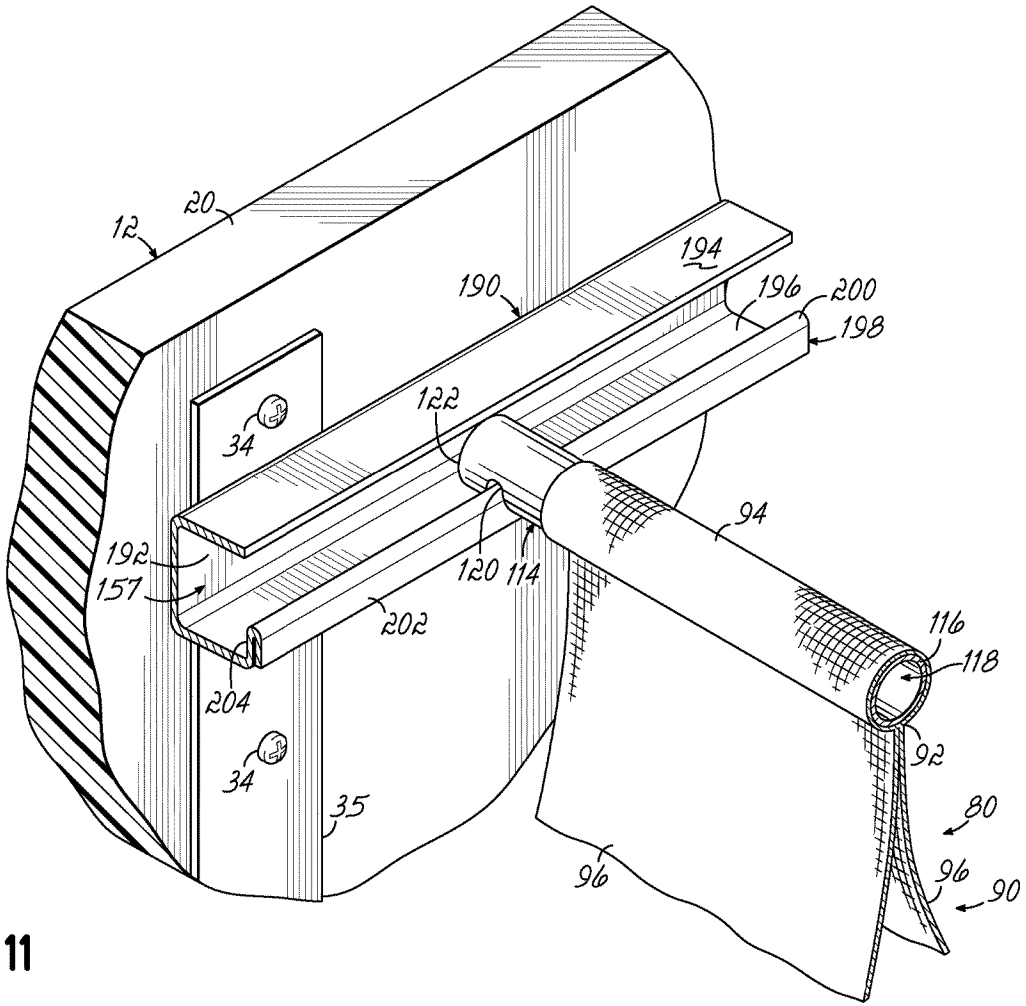
FIG. 11 is a perspective view like FIG. 6 showing a different track.

FIG. 11 illustrates a different generally C-shaped track 190 which may be used in any of the containers and/or embodiments illustrated or described herein. The track 190 may be welded or otherwise secured to braces 35 which are secured to the body 12 and, more particularly, to opposed sides or side structures 16, 20 of the body 12 via fasteners 34, as best shown in FIG. 11. However, the tracks 190 may be secured directly to the container body 12 in any known manner without the use of braces. In either case, a container body, regardless of whether the body is a wall as shown or the side of a metal rack (like the rack shown in FIG. 18), may support multiple tracks 190, either directly or indirectly in any of the embodiments shown or described herein.

Track 190 comprises a back 192, an upper wall 194 and a lower wall 196 each extending outwardly from the back 202. The track 190 further comprises a lower lip 198 extending upwardly from the lower wall 196. The lower lip 198 is folded or bent (turned downwardly in FIG. 11) to create a rounded, longitudinally extending edge 200. The lower lip 198 thereby becomes two ply with an outer layer or ply 202 outside an inner ply 204. The lower lip 198 may be folded outwardly as shown in FIG. 11 or folded inwardly the other direction to create rounded edge 200. FIG. 11 illustrates a dunnage support 114 extending between two of the tracks 190 (only one being shown). The dunnage support 114 is the same dunnage support shown in FIG. 6 and described above. Similarly, the dunnage pouches 90 are identical to those shown in FIG. 6.

Figure 12:
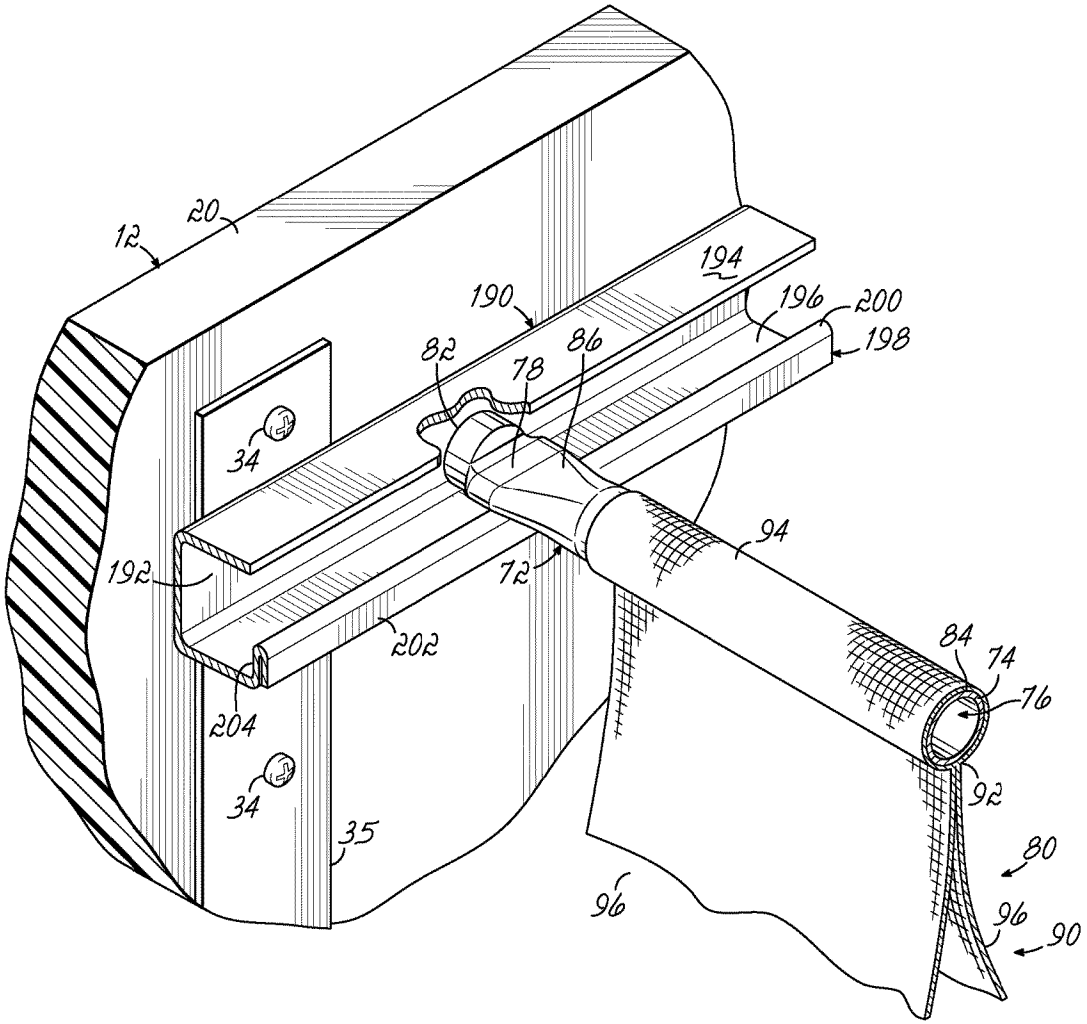
FIG. 12 is a perspective view like FIG. 11 showing a different dunnage support.

FIG. 12 illustrates the same generally C-shaped track 190 shown in FIG. 11 and described herein, welded or otherwise secured to braces 35. Braces 35 are secured to the body 12 and, more particularly, to opposed sides or side structures 16, 20 of the body 12 via fasteners 34. A dunnage support 72 is the same dunnage support shown in FIGS. 2 and 2A and described above. Similarly, the dunnage pouches 90 are identical to those shown in FIGS. 2 and 2A.

Figure 13:
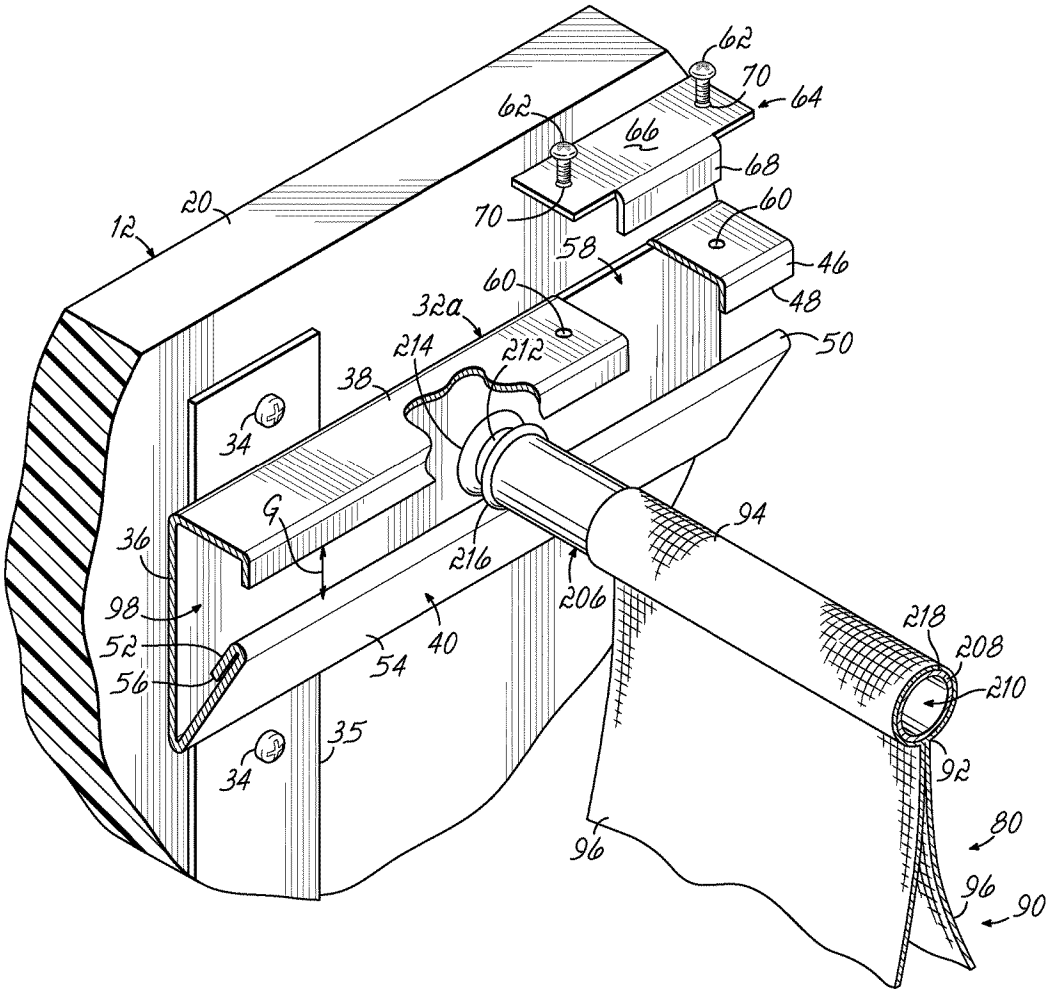
FIG. 13 is a perspective view like FIG. 12 showing a different track.

FIG. 13 illustrates the same track 32*a* shown in FIGS. 2 and 2A and described herein, welded or otherwise secured to braces 35. Braces 35 are secured to the body 12 and, more particularly, to opposed sides or side structures 16, 20 of the body 12 via fasteners 34. As shown in FIG. 13, each dunnage support 206 has a tubular wall 208 and a hollow interior 210. Dunnage support 206 has two narrowed portions 212, one at each end (only one being shown) which contact and move along the rounded edges 50 of opposed tracks 32*a* at the same vertical level or height. Each dunnage support 206 has a pair of heads 214, 216 at the end of the dunnage support 206. Head 214 is furthest from the middle portion 218 of the dunnage support 206, and head 216 is spaced inwardly from head 214. The heads 214, 216 are spaced from one another to define a groove or narrowed portion 212 therebetween which receives and retains one of the rounded edges 50 of one of the stationary tracks 32*a*. As shown in FIG. 13, head 214 is located inside the interior 98 of track 32*a*, and head 216 is located outside the interior 98 of stationary track 32*a*. Head 214 keeps the dunnage support 206 engaged with the track 32*a*, while head 216 keeps the dunnage material 80 out of the interior 98 of the track 32*a*, thereby ensuring that the dunnage supports 206 may move smoothly along the stationary tracks. Each dunnage support 206 may be a single unitary piece or multiple pieces joined together as shown generally in FIGS. 14 and 15.

Figure 14:
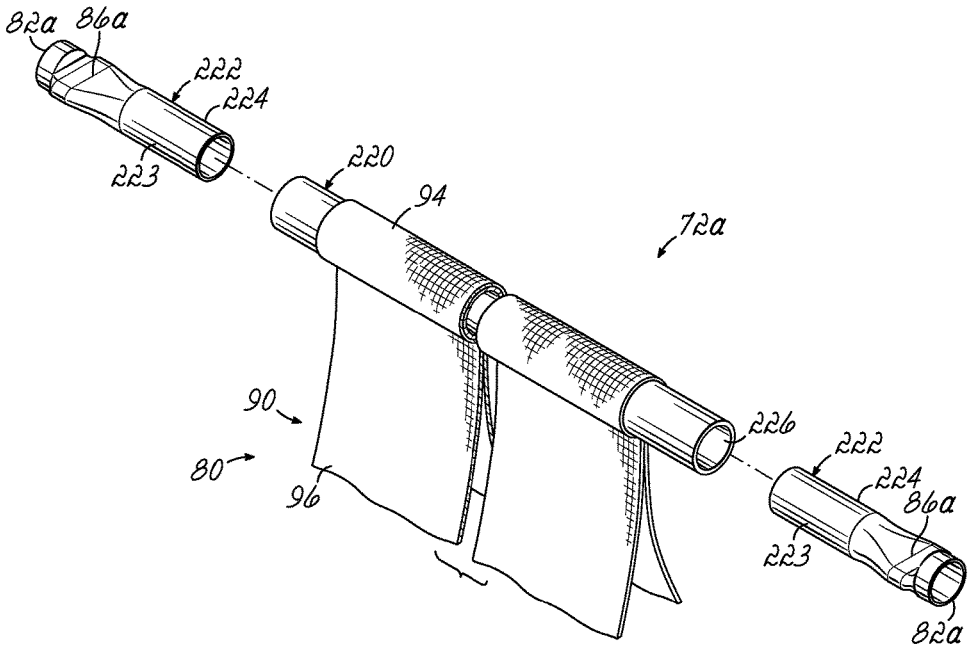
FIG. 14 is a partially disassembled perspective view of an alternative version of dunnage support.
Figure 15:
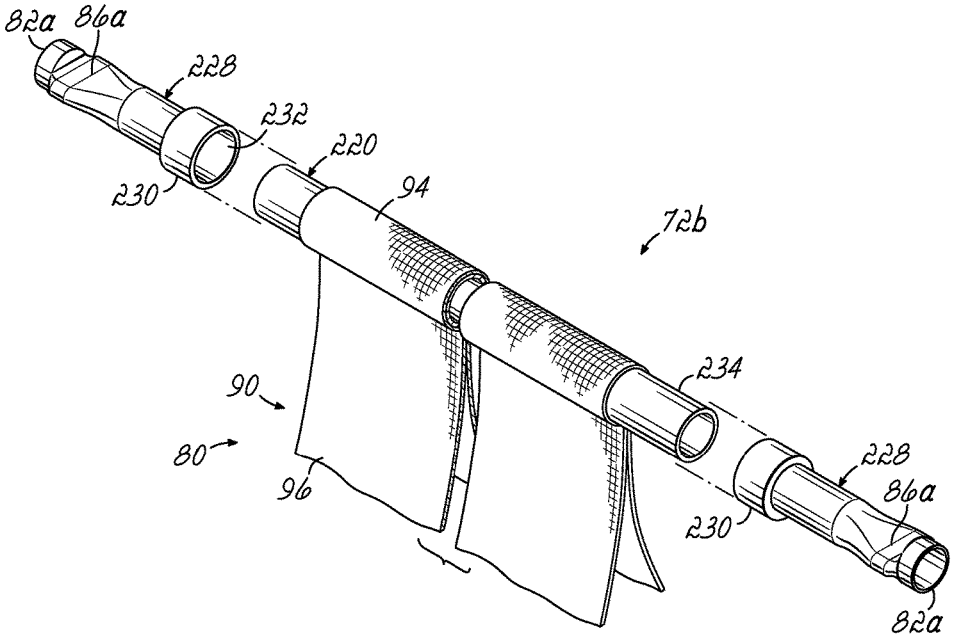
FIG. 15 is a partially disassembled perspective view of another version of dunnage support.

FIGS. 14 and 15 illustrate alternatives to the dunnage supports 72, best shown in FIGS. 2 and 2A. Rather than being a unitary member, any of the dunnage supports shown or described herein supporting dunnage (and parts if loaded) may comprise multiple members. FIG. 14 shows one such possibility comprising a dunnage support 72*a*, similar to dunnage support 72 shown in FIGS. 2 and 2A, but made of multiple pieces. Dunnage support 72*a* has a tubular middle section 220 around which the receiver 94 of dunnage 80 is located and two opposed end sections 222. Each end section 222 has a hollow connecting portion 223 having an outer diameter 224 slightly less than the inner diameter 226 of the middle section 220 so that the end sections 222 may fit inside hollowed ends of the middle section 220. Each of the end sections 222 has a flattened or crimped portion 86*a* sized to slide along one of the rounded edges of one of the tracks shown or described herein. Each of the end sections 222 also has an end portion 82*a* adapted to move inside the interior of one of the tracks similar to end portions 82 of unitary dunnage support 72.

FIG. 15 shows another possibility comprising a dunnage support 72*b* having a tubular middle section 220 and two opposed end sections 228. Each end section 228 has a hollow connecting portion or collar 230 having an inner diameter 232 slightly greater than the outer diameter 234 of the middle section 220 so that the end sections 228 may fit over the middle section 220. Each of the end sections 228 has a flattened or crimped portion 86*b* sized to slide along one of the rounded edges of one of the tracks shown or described herein. Each of the end sections 228 also has an end portion 82*b* adapted to move inside the interior of one of the tracks similar to end portions 82 of unitary dunnage support 72.

Figure 16A:
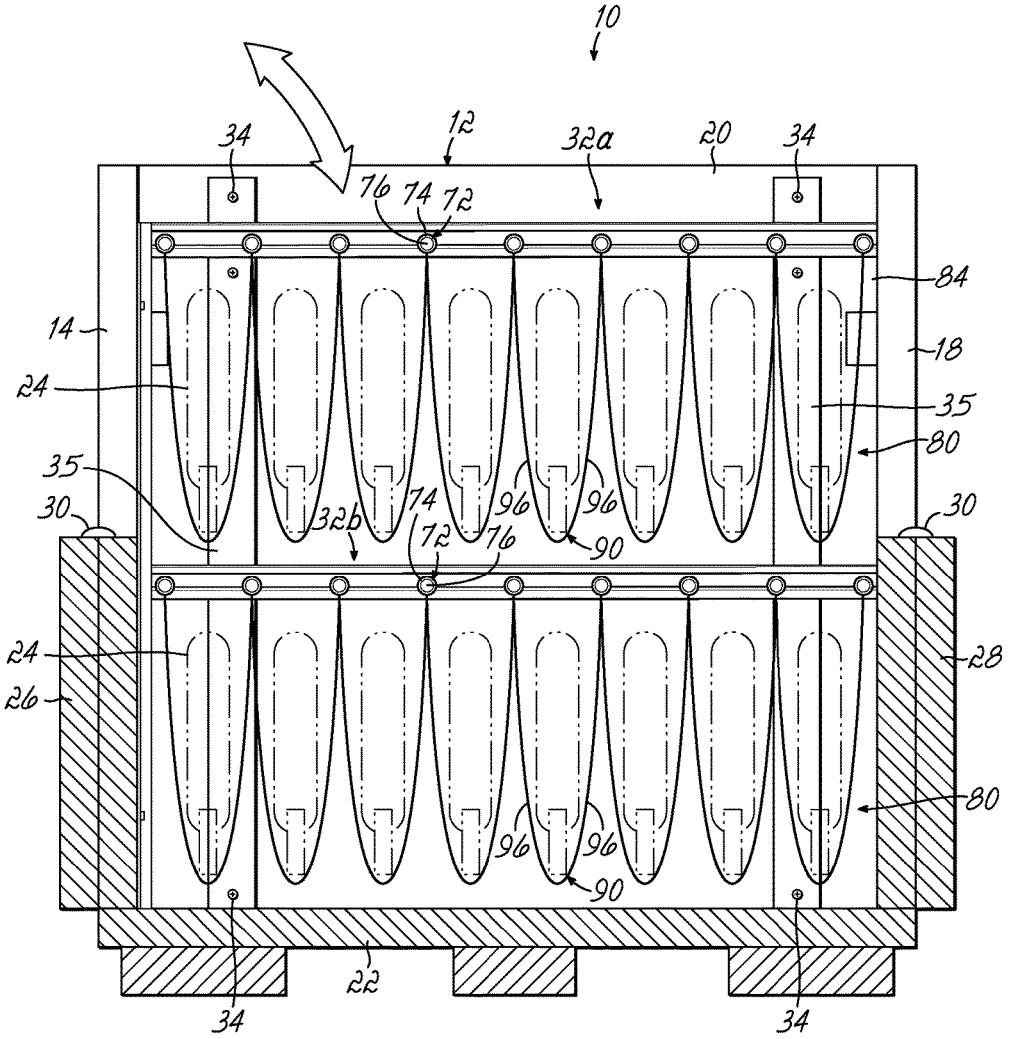
FIG. 16A is a side elevational view of the container of FIG. 1 loaded with product shown in dashed lines.
Figure 16B:
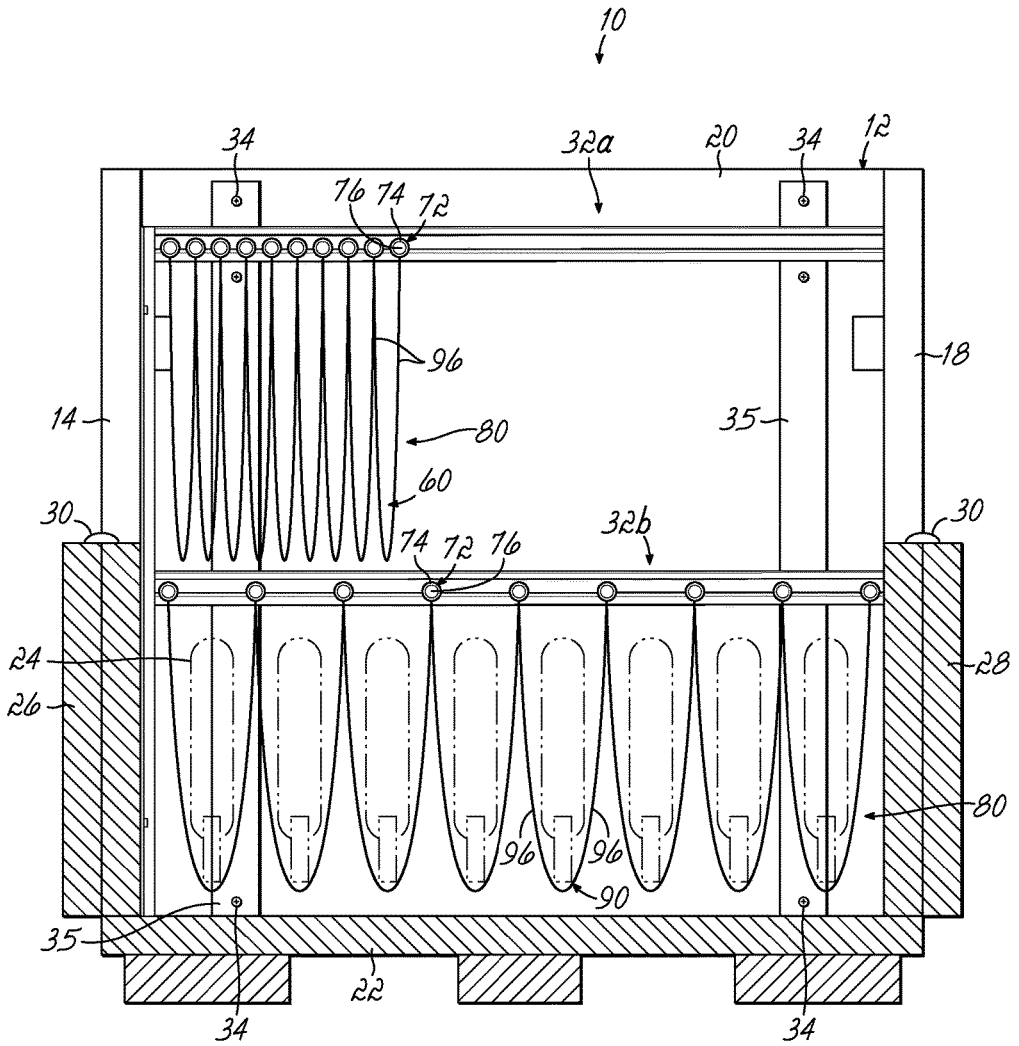
FIG. 16B is a side elevational view of the container of FIG. 16A, showing the upper level of product having been unloaded or the lower level of product having been loaded.
Figure 16C:
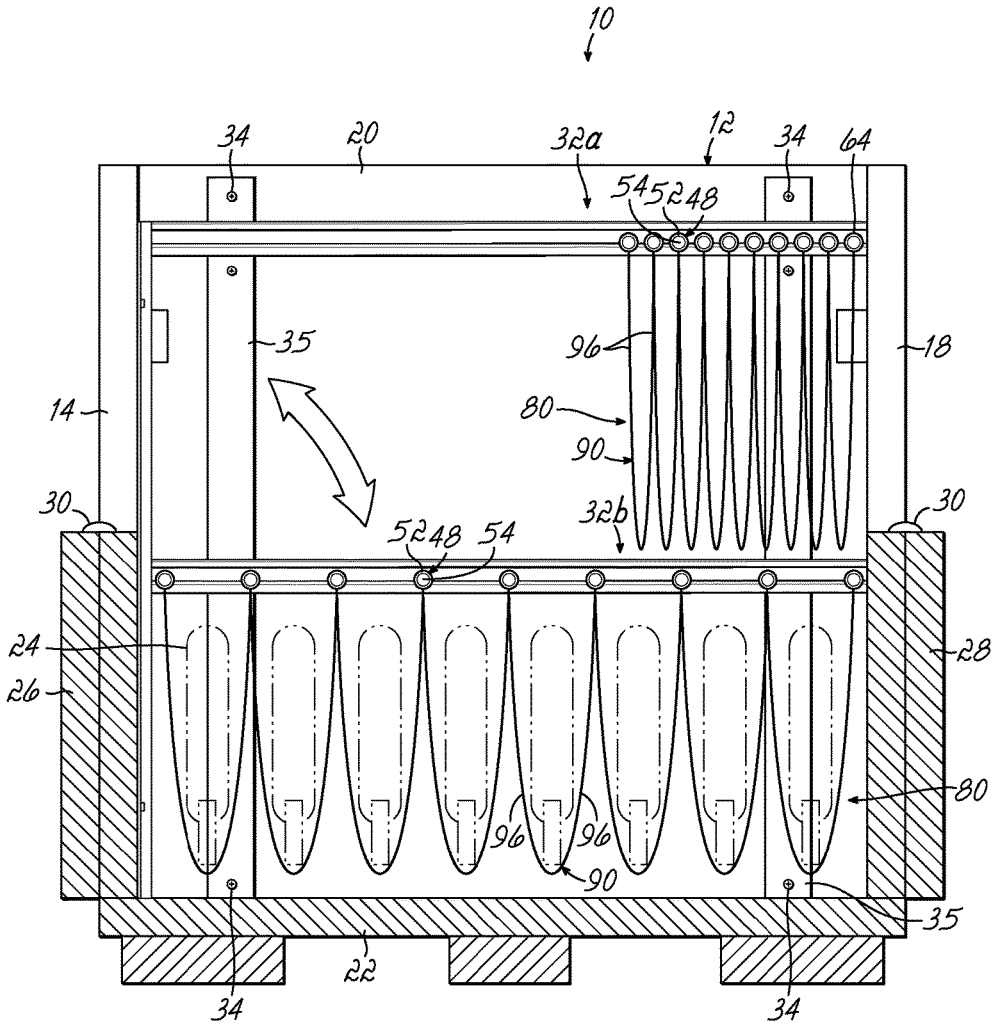
FIG. 16C is a side elevational view of the container of FIG. 16A, showing the lower level of product being loaded or unloaded.

FIGS. 16A, 16B and 16C illustrate the process of unloading products 24 from the container 10 and loading products 24 into the container 10. Each level or layer of dunnage supports 72 is adapted to move from back to front inside the interior of the container 10 in a manner described herein.

Operationally, the method of unloading product from the container 10 comprises the following steps. For purposes of this explanation, the operator or person doing the unloading ("the unloader") is located proximate the front of the container. First, as shown in FIG. 16A, products 24 suspended in the pouches 90 of the upper layer or level are lifted out the top of the container 10. One or both of the doors 26, 28 may be open, but need not be open. FIG. 16A illustrates both doors open. Preferably, within any level or layer or row, products 24 suspended in pouches 90 closer to the unloader are removed before products further away from the unloader. The dunnage supports 72 supporting empty pouches 90 with the level are then moved alongside each other at the front of the container. They are now positioned nearest to the unloader, as shown in FIG. 16B. The unloader may then move the entire group of dunnage supports 72 and attached empty pouches 90 to a position away from the unloader, as shown in FIG. 16C, to gain access to products 24 in the next lowest level or layer.

The unloader may then remove a second, lower row of products 24 suspended by pouches 90 supported by the second level of dunnage supports 72 extending between and supported by the tracks 32*b*. This process continues one level at a time until all products have been removed from all the levels of pouches of the container 10 and all of the dunnage supports 72 are pulled forwardly and resting against one another proximate the rear structure 14 of the container 10. As shown in FIG. 16C, to remove the last or lowermost row of product, the unloader need only reach a limited distance over the container or into the container, especially if the front door 26 is open.

Operationally, the method of loading product into the container 10 comprises the following steps. For purposes of this explanation, the operator or person doing the loading ("the loader") is located proximate the front of the container. First, as shown in FIG. 16C, products 24 are inserted through the top of the container 10 into the pouches 90 of the lowest level of dunnage so they are suspended by such dunnage. One or both of the doors 26, 28 may be open, but need not be open. FIGS. 16A, 16B and 16C illustrate front and rear doors 26, 28 open, but one or both may be closed for either loading or unloading. Preferably, within any level or layer, the loader inserts products 24 inside pouches 90 close to him/her and slides them toward the rear of the container before loading additional products 24 inside the empty pouches closer to him/her. The dunnage supports 72 supporting full or loaded pouches 90 with the level are then moved rearwardly so that they are positioned away from the loader until the entire row of pouches is full (see FIG. 16C). The loader may then move the entire group of dunnage supports 72 and attached empty pouches 90 of the next highest level or layer to a position close to the loader as shown in FIG. 16B to load them with products 24.

The loader may then insert a second row of product 24 suspended by pouches 90 supported by the upper level of dunnage supports 72 extending between and supported by the tracks 32*a*. This process may continue one level at a time until all of the pouches of all the levels of the container 10 are suspending products 24. As shown in FIGS. 16A, 16B and 16C, to load product into pouches of the lowermost level, the loader need only reach a limited distance over the container or into the container, especially if one or both of the doors 26, 28 is open.

Figure 17:
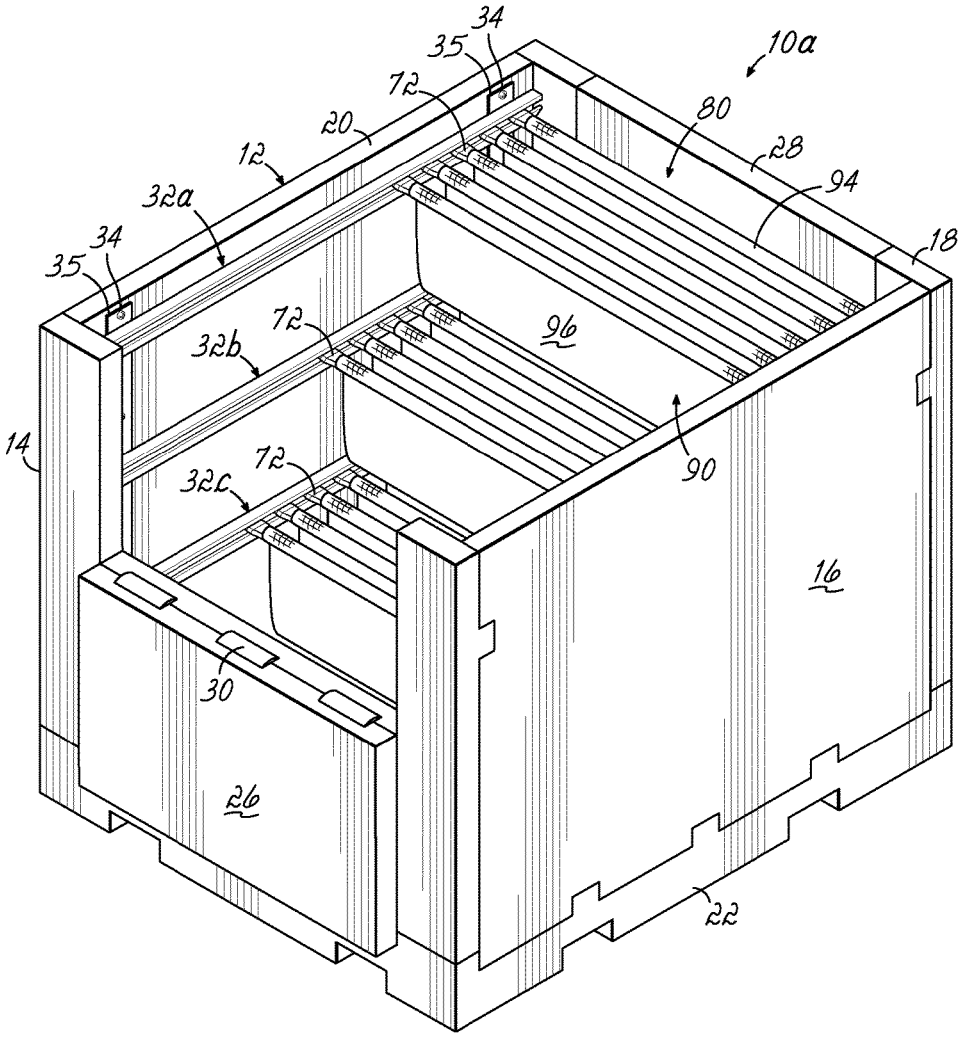
FIG. 17 is a perspective view of an alternative embodiment of a reusable and returnable container having three levels or layers of tracks, dunnage supports and associated dunnage in the form of pouches.

FIG. 17 illustrates an alternative embodiment of container 10*a*. Container 10*a* is identical to container 10, except the container has three, as opposed to only two, levels of tracks 32*a*, 32*b*, 32*c* and dunnage supports 72 supporting the dunnage 80. For simplicity, like parts have the same numbers.

FIG. 18 illustrates a reusable and returnable container 10*b* according to another embodiment. This container is known in the art as a rack and is typically made of metal, but may be made of other materials. The reusable and returnable container 10*b*, as shown, comprises a body 236 having four corner posts 238 and a bottom or base 240. Each corner post 238 has a knob 239 at the top of the corner post 238. This enables containers 10*b* to be stacked on top of each other, the knobs 239 fitting inside the hollow corner posts 238 of the other container on top. The body 236 has a front beam 242 and a front member 244 secured to and extending between front corner posts 238 and a rear beam 245 secured to and extending between rear corner posts 238. The container 10*b* further comprises three side members 246 secured to and extending between front and rear corner posts 238 on the same side of the container. The container 10*b* further comprises two braces 35 secured with fasteners 34 to each of the three side members 246 on each side of the container. Of course, this rack-style container may include any number of braces, beams and/or tracks. This document is not intended to be limited to any one configuration of metal rack container. For example, although one style of base 240 is shown in FIG. 18, the base may assume other configurations.

Container 10*b* further comprises a plurality of tracks 32*a*, 32*b*, 32*c* arranged in pairs. The tracks 32*a*, 32*b* and 32*c* are secured to braces 35 which are secured to and supported by opposed side members 246 of the body 236. However, the tracks 32*a*, 32*b* and 32*c* may be secured in any known manner, such as welding to any number of side members of the container body 236. Thus, the tracks 32*a*, 32*b* and 32*c* may be supported by and secured to the container body 236.

FIG. 18 shows container 10*b* having three levels or vertically spaced layers of dunnage supports 72 and associated dunnage supported by tracks 32*a*, 32*b* and 32*c*. However, this document is not intended to limit the number of levels or layers of dunnage supports or dunnage of this or any of the containers shown or described herein.

Figure 19:
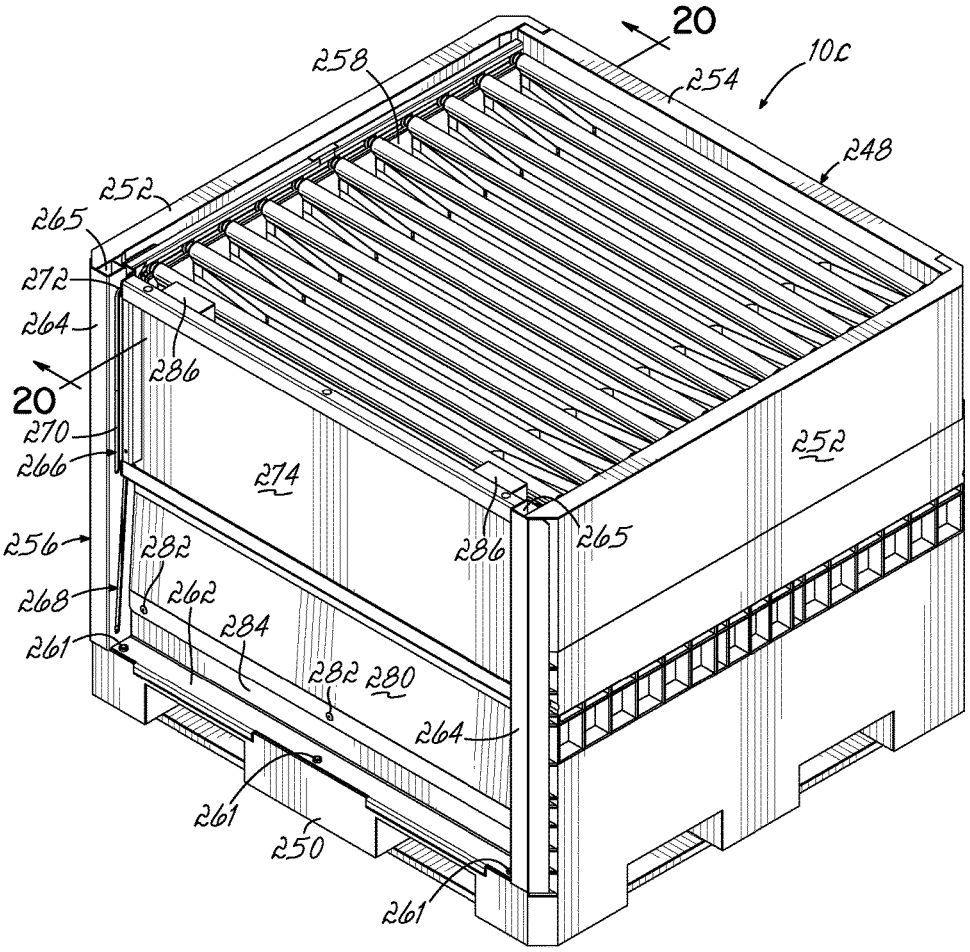
FIG. 19 is a perspective view of another embodiment of a reusable and returnable container showing one layer of tracks, dunnage supports and associated dunnage in the form of pouches.
Figure 20:
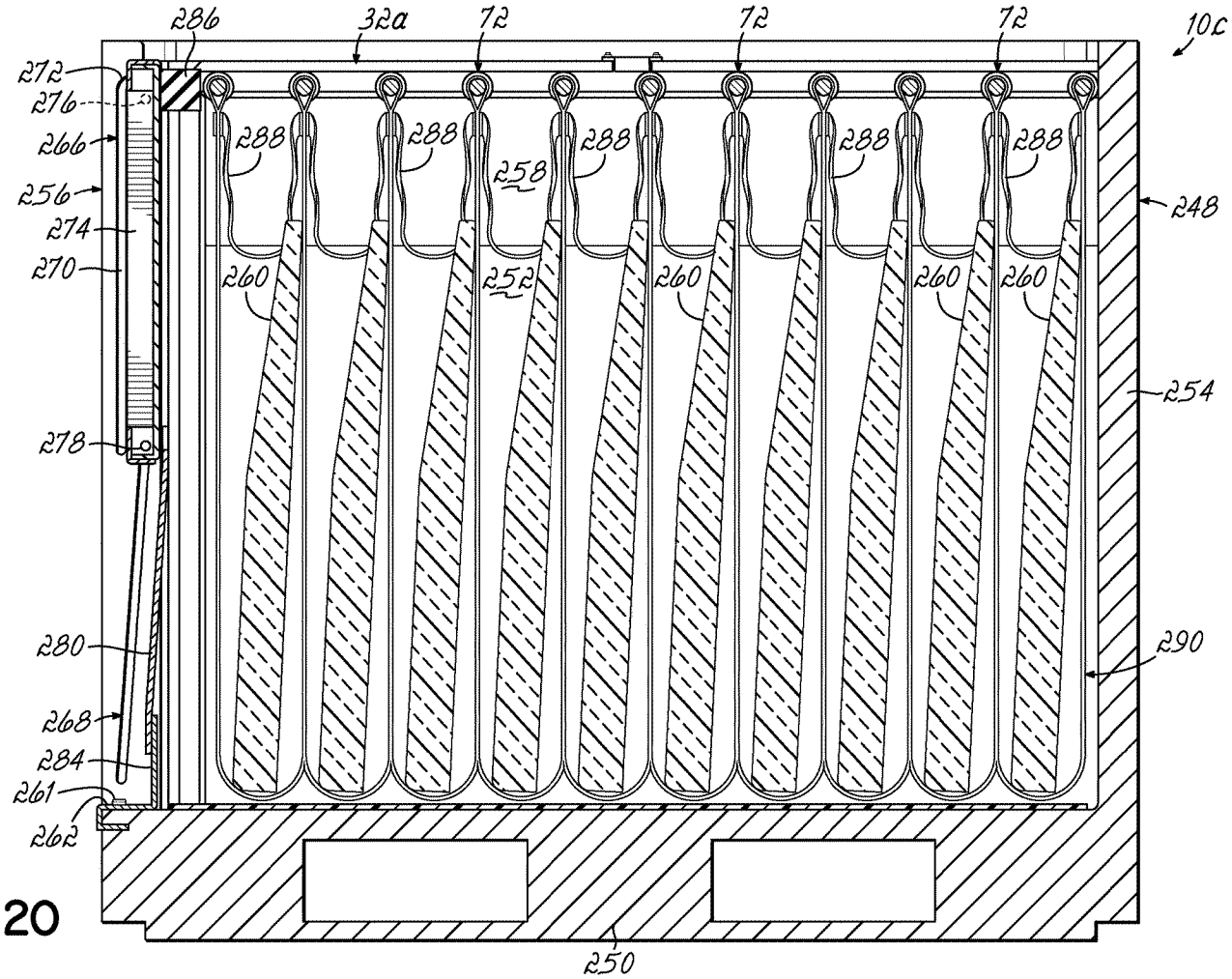
FIG. 20 is a cross-sectional view taken along the line 20-20 of FIG. 19.

FIGS. 19 and 20 illustrate a reusable and returnable container 10*c* according to another embodiment. Features of the container 10*c* and other similar containers are disclosed in U.S. patent application Ser. No. 13/616,635 filed Sep. 14, 2012 and Ser. No. 13/888,686 filed May 7, 2013 and Ser. No. 13/896,675 filed May 17, 2013 and Ser. No. 13/975,682 filed Aug. 26, 2013, which are each fully incorporated by reference herein.

The reusable and returnable container 10*c*, as shown, comprises a body 248 having a base 250, opposed side walls 252 and a rear wall 254, all extending upwardly from the base 250. The side walls 252 and rear wall 254 may be hingedly secured to the base 250. A generally U-shaped front frame 256 may be fixedly secured to the side walls 252 and does not move relative to the side walls 252 after the container is assembled. The front frame 256 may be made of metal or any other suitable material.

As shown in FIG. 20, a bumper 258 may be secured to each of the side walls 252 (only one being shown). Each bumper 258 protects the products 260 from contacting the side walls 252 and being scratched or damaged in some fashion. The bumpers may be made of foam or any other suitable material. If desired, the bumpers may be omitted.

Although one specific shape of product 260 is illustrated in the drawings, this document is not intended to limit in any way the size, shape or configuration of product 260 shipped or stored in any of the embodiments described or shown herein. One type of product which may be used in accordance with the present invention is car door panels.

Although one type of container is illustrated, the present invention may be used with other types or configurations of container. For example, each side wall may not be a solid wall.

As best shown in FIG. 19, the front frame 256 comprises a frame base 262 and two side posts 264 extending upwardly from the frame base 262. The frame base 262 is fixedly secured to the base 250 of the container 10*c* with rivets or fasteners 261, while the side posts 264 of the front frame 260 are secured to the container side walls 252.

Each of the side posts 264 of the front frame 260 is generally rectangular in cross-section and has a hollow interior 265. Each of the side posts 264 of the front frame 260 has two slots therethrough, an upper slot 266 and a lower slot 268. However, any number of slots of any desired shape may be incorporated into the side posts. As best shown in FIG. 20, upper slot 266 has a "candy cane" shape comprising a straight portion 270 and a curved upper portion 272. The lower slot 268 is linear, as best illustrated in FIG. 20. These upper and lower slots 266, 268 are used to secure a movable door segment 274 in a fixed position and guide the door segment 274 during its movement from an upper or raised position and a lower or dropped position. As best shown in FIG. 20, the door segment 274 has a pair of upper pins 276 extending outwardly from the door segment 274 and adapted to ride or move inside the upper slots 266. Similarly, the door segment 274 has a pair of lower pins 278 extending outwardly from the door segment 274 and adapted to ride or move inside the lower slots 268. FIG. 20 shows the door segment 274 locked in a raised position with the upper pins 276 located at the upper ends of the curved portions 272 of the upper slots 266. As the door segment 274 is lowered, it moves outside a stationary shield 280 secured with rivets or fasteners 282 to a vertically oriented flange 284 of the base 262 of the front frame 256. See FIG. 20.

As best shown in FIGS. 19 and 20, spaced stops 286 are secured to the movable door segment 274. The stops 286 may be made of foam or any other suitable material. When the door segment 274 is in its raised position, stops 286 function to prevent the dunnage supports 72 and associated dunnage 80 prevent products 260 from hitting the door segment 274 during the loading or unloading process. Although two stops 286 are illustrated per door segment 274, a continuous stop or a different number of stops may be utilized of any desired configuration or size.

As best shown in FIG. 20, container 10*c* further comprises a generally track 32*a* secured to each side wall 252 of the container 10*c*, which does not move relative to the side wall 252 after the container 10 is assembled and during the loading or unloading processes (only one being shown in FIG. 20).

Although one configuration of drop-down door is shown in FIGS. 19 and 20 and described herein, any other drop-down door as shown and described in any of the following patents applications may be incorporated into any of the containers described or shown herein: U.S. patent application Ser. No. 13/616,635 filed Sep. 14, 2012; Ser. No. 13/888,686 filed May 7, 2013; Ser. No. 13/896,675 filed May 17, 2013; and Ser. No. 13/975,682 filed Aug. 26, 2013.

The reusable and returnable container 10*c* may also have at least one space limiter or strap 288 which, as shown in FIG. 20, limits the distance the dunnage supports 72 may be moved away from one another due to the fact that each space limiter 288 is secured to the dunnage of adjacent dunnage supports 72. Typically, the length or distance of the space limiter 288 between locations where the space limiter 288 is secured to the dunnage will be fixed to prevent the dunnage supports 72 from moving farther apart than necessary for the insertion or removal of product 260 into or from the pouches 290. The space limiter 288 may be secured to the dunnage 290 in any suitable fashion, including but not limited to, sewing, fastening, etc. Of course, when the dunnage supports 72 are moved to a position adjacent to one another, the flexibility of the space limiters 288 allows for such movement. The space limiter 288, as shown, is preferably comprised of a fabric strap, but may be made of any other suitable material, such as plastic. Preferably, two space limiters or straps 288, one on each side of a pouch 290, connect adjacent walls of a pouch 290. However, any number of straps 288 may be used to connect any number of pouches.

Although container 10*c* shown in FIGS. 19 and 20 has only one set of stationary tracks, as opposed to multiple sets of stationary tracks, any of the containers shown or described herein may have only a single set of stationary tracks. The tracks may any of those shown or described herein and may be used in connections with any one of the dunnage supports shown or described herein, regardless of whether the dunnage supports are unitary members or made from multiple-pieces.

In any of the embodiments shown or described herein, each level or layer of dunnage inside the container may comprise a single piece of material used to create pouches. However, multiple pieces of material may be used in any one or more levels or layers of dunnage. The material may be a textile material, such as polyester. However, this document is not intended to limit the material of the dunnage/pouches.

While various embodiments of the present invention have been illustrated and described in considerable detail, it is not the intention of the applicant to restrict or in any way limit the scope of the claims to such detail. Additional advantages and modifications will readily appear to those skilled in the art. The invention in its broader aspect is, therefore, not limited to the specific details, representative system, apparatus, and method, and illustrative example shown and described. Accordingly, departures may be made from such details without departing from the spirit or scope of the applicant's general inventive concept.

What is claimed is:

1. A container for holding product therein during shipment, the container comprising:

a bottom and at least two side structures;

multiple levels of tracks supported by opposed side structures, each of the tracks of at least one of the levels having a back, upper and lower walls extending outwardly from the back, upper and lower lips extending towards each other, at least one of the lips being folded back upon itself to create a rounded edge;

dunnage supports extending between and supported by the tracks of the at least one of the levels, at least some of the dunnage supports having flattened portions at opposed ends thereof, said flattened portions contacting and being slidable along the rounded edges; and dunnage supported by the dunnage supports.

2. The container of claim 1 wherein the dunnage comprises pouches.

3. The container of claim 1 wherein at least one of the dunnage supports is made of multiple pieces.

4. The container of claim 1 wherein at least one of the dunnage supports is a one piece metal member.

5. The container of claim 1 wherein the container has at least three vertical levels of tracks.

6. A container for holding product therein during shipment, the container comprising:

a bottom and at least two sides;

tracks supported by opposed sides at different vertically spaced levels, each of the tracks at one of the levels having a lower lip having a rounded edge having inner and outer plies formed by folding the material of the track;

a plurality of dunnage supports extending between opposed tracks at the same vertical level, each of the plurality of dunnage supports having flattened portions and end portions, each of the end portions residing inside an interior of one of the tracks and two of the flattened portions extending through gaps in opposed tracks, the flattened portions being engaged with and slidable along the rounded edges of the opposed tracks; and dunnage suspended from the dunnage supports.

7. The container of claim 6 wherein said dunnage comprises pouches.

8. The container of claim 6 wherein each of the tracks and each of the plurality of dunnage supports is metal.

9. The container of claim 6 wherein each of the plurality of dunnage supports is tubular.

10. A container for holding product therein during shipment, the container comprising:

a bottom and at least two sides;

braces secured to opposed sides;

vertically spaced sets of tracks secured to each of the braces, each of the tracks of at least one of the sets of tracks comprising a back, walls extending outwardly from the back, lips extending towards each other, at least one of the lips having a rounded edge having inner and outer plies formed by folding the material of the track upon itself to facilitate movement of a plurality of movable dunnage supports, each of the plurality of dunnage supports having a flattened portion at each end, the flattened portion of each dunnage support being engaged with and slidable along the rounded edges of the tracks of the at least one of the sets of tracks to facilitate movement of the dunnage supports inside the container; and dunnage supported by the dunnage supports.

11. The container of claim 10 wherein each of the plurality of dunnage supports is tubular.

12. The container of claim 10 wherein the braces, tracks and the plurality of dunnage supports are made of metal.

13. The container of claim 10 wherein the dunnage comprises pouches.

* * * * *